US007775917B2

(12) United States Patent
Nye et al.

(10) Patent No.: US 7,775,917 B2
(45) Date of Patent: Aug. 17, 2010

(54) BASKETBALL SYSTEM

(75) Inventors: S. Curtis Nye, Clinton, UT (US); Aaron Hill, Layton, UT (US); Doug Fuller, Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 746 days.

(21) Appl. No.: 11/500,791

(22) Filed: Aug. 7, 2006

(65) Prior Publication Data

US 2007/0054759 A1 Mar. 8, 2007

Related U.S. Application Data

(60) Provisional application No. 60/706,637, filed on Aug. 8, 2005, provisional application No. 60/777,241, filed on Feb. 27, 2006.

(51) Int. Cl.
*A63B 63/08* (2006.01)

(52) U.S. Cl. ..... 473/483; 248/281.11

(58) Field of Classification Search ..... 473/481, 473/479, 484, 483
See application file for complete search history.

(56) References Cited

U.S. PATENT DOCUMENTS 4,781,375 A 11/1988 Nye
4,801,142 A * 1/1989 Friesen ..... 473/484
4,805,904 A 2/1989 Nye
4,881,734 A 11/1989 Nye
5,037,092 A * 8/1991 Blackburn ..... 473/481
5,098,092 A * 3/1992 Aakre et al. ..... 473/483
5,207,419 A * 5/1993 Schroeder ..... 473/481
5,255,909 A * 10/1993 Wendell ..... 473/481
5,324,027 A 6/1994 Nye
5,695,417 A 12/1997 Winter et al.
5,879,247 A 3/1999 Winter et al.
5,916,048 A * 6/1999 Hurell et al. ..... 473/479
6,077,177 A 6/2000 Winter et al.
6,120,396 A 9/2000 VanNimwegen et al.
6,135,901 A * 10/2000 van Nimwegen ..... 473/484
6,142,891 A 11/2000 Winter et al.
6,155,938 A 12/2000 Mower
6,273,834 B1 8/2001 Winter
6,283,878 B1 * 9/2001 White ..... 473/484
6,302,811 B1 * 10/2001 Topham ..... 473/484
6,402,644 B2 6/2002 Stanford et al.
6,419,597 B1 7/2002 VanNimwegen et al.
6,419,598 B1 7/2002 Winter et al.
6,422,957 B1 7/2002 Winter et al.

(Continued)

*Primary Examiner*—Alvin A Hunter
*Assistant Examiner*—M Chambers
(74) *Attorney, Agent, or Firm*—Workman Nydegger

(57) ABSTRACT

A basketball system may include a basketball goal with a backboard and a rim. The basketball system may also include a support structure that is sized and configured to support the basketball goal above a playing surface. The support structure may include an elongated support member that is generally vertically disposed relative to the playing surface and a single support assembly which connects the elongated support member to the basketball goal. The single support assembly may include first and second connecting members that connect the elongated support member and the basketball goal. Desirably at least a portion of the second connecting member is disposed within a portion of the first connecting member. In addition, the basketball system may include a height adjustment mechanism to allow the height of the basketball goal to be adjusted.

20 Claims, 18 Drawing Sheets

U.S. PATENT DOCUMENTS

| | | | | |
|---|---|---|---|---|
| 6,432,003 | B1 | 8/2002 | van Nimwegen | |
| 6,488,599 | B2 | 12/2002 | Nye | |
| 6,645,095 | B1 | 11/2003 | Nye et al. | |
| 6,656,065 | B2 | 12/2003 | Nye | |
| 6,699,146 | B1 | 3/2004 | Winter et al. | |
| 6,837,810 | B1 * | 1/2005 | McAllister et al. | 473/483 |
| 6,916,257 | B1 | 7/2005 | van Nimwegen | |
| 7,044,867 | B2 | 5/2006 | van Nimwegen | |
| 7,118,500 | B2 | 10/2006 | Nye et al. | |
| 7,320,652 | B2 * | 1/2008 | Kilpatrick | 473/483 |
| 2004/0185971 | A1 | 9/2004 | Nye et al. | |

* cited by examiner

118

BASKETBALL SYSTEM

CROSS-REFERENCE TO RELATED APPLICATIONS

This application claims priority to and the benefit of U.S. Provisional Patent Application Ser. No. 60,706,637, entitled Basketball System, which was filed on Aug. 8, 2005, and U.S. Provisional Patent Application Ser. No. 60,777,241, entitled Basketball System, which was filed on Feb. 27, 2006, each of which is hereby incorporated by reference in its entirety.

BACKGROUND OF THE INVENTION

1. Field of the Invention

The present invention generally relates to a basketball system and, in particular, to a support structure for a basketball goal.

2. Description of Related Art

The game of basketball is played by many people throughout the United States and the world. Briefly, the game of basketball typically includes a flat and level playing surface with a basketball goal at each end of the court. The basketball goal, which may include a backboard and a rim or hoop, is typically attached to the top of a support pole. The rim or hoop is normally located ten feet above the playing surface and the backboard may be constructed from materials such as wood, plastic or tempered glass.

Conventional basketball goals typically include a backboard that is positioned perpendicular to the playing surface and a rim that is positioned parallel to the playing surface. The rim is often rigidly mounted to the basketball backboard or goal, but the rim may also be pivotally mounted to the basketball backboard or goal to create a movable or break-away type rim.

Conventional basketball systems may be permanently secured in a fixed location. For example, the end of the support pole may be inserted into the ground. Conventional basketball systems may also be part of a portable basketball system in which the system may be selectively moved from one location to another. For example, known portable basketball systems may include a base with a hollow interior that is sized and configured to be filled with ballast such sand or water. These known portable basketball systems may include one or more wheels to facilitate movement of the basketball system. These known portable basketball systems may also include a handle to facilitate movement of the basketball system.

Basketball systems that allow the height of the basketball goal relative to the playing surface to be adjustable are also known. These known adjustable height basketball system may allow basketball to be played by a wide variety of persons. For instance, the adjustable height basketball system may be used by relatively tall players for some games and by shorter players during other games. The adjustable height basketball system may also be used by players of different strengths or skill levels. In addition, the adjustable height basketball system may be used by adults or children. Further, the adjustable height basketball system may also be used to play a regulation game of basketball or for practicing skills such as dunking the basketball.

Many conventional adjustable height basketball systems, however, are difficult and/or time consuming to adjust. Many conventional adjustable height basketball systems also include complicated designs with numerous parts and connections, which may undesirably increase the cost of the system. Additionally, many known adjustable height basketball systems are difficult to assemble and require a large amount of space. Further, many of these known systems include large and/or obstructive components, which can interfere with play and can make the basketball system more difficult to ship, store and/or assemble. The large and bulky components may also create an unpleasing appearance or design of the basketball system.

BRIEF SUMMARY OF EMBODIMENTS OF THE INVENTION

A need therefore exists for a basketball system that eliminates or diminishes the above-described disadvantages and problems.

One aspect is a basketball system that may include a basketball goal, which may include a backboard, a rim and a net. The basketball system may also a support structure that is sized and configured to support the basketball goal at a desired height above a playing surface. The support structure is preferably sized and configured to selectively support the basketball goal at a plurality of heights. For example, the support structure may support the rim ten feet above the playing surface, which is the conventional height for a basketball goal, and the support structure may support the rim at other heights. In particular, the support structure may support the rim at lower heights, such as nine feet, eight feet, seven feet, six feet or other desired heights. The support structure may also support the rim at a greater height, if desired. Advantageously, the support structure may allow adults, children and others to play basketball.

Significantly, the support structure may form part of a permanent or portable basketball system. The support structure may also be used with different types of basketball systems and/or components such as different types, sizes and configurations of backboards, rims and the like.

Another aspect is a basketball system that may include a support structure which includes one or more support members. One or more of the support members may be movable or adjustable, which may allow the height of the basketball goal to be adjusted. The support members, however, do not have to be adjustable and the height of the basketball goal does not have to be adjustable.

Yet another aspect is a basketball system that may include an adjustment assembly which is sized and configured to adjust the height of basketball goal. For example, the basketball system may include a support structure with one or more support members and the adjustment assembly may be sized and configured to move at least a portion of at least one of the support members so the height of the basketball goal may be adjusted.

A further aspect is a basketball system that may include an adjustment assembly which includes a jack. The jack may be sized and configured, for example, to adjust the height of the basketball system. In particular, the jack may be used to move one or more support members to allow the height of the basketball goal to be adjusted. The jack may include a release, handle or trigger to facilitate use of the jack and/or adjustment assembly.

A still further aspect is a basketball system that may include an adjustment assembly which includes a biasing member, such as a gas spring. The gas spring, for example, may be sized and configured to bias one or more support members of the support structure into a particular position or configuration. This may facilitate adjusting the height of the basketball goal. The gas spring is preferably movable between one or more positions to move the support members into different positions. The adjustment assembly may include a release, handle or trigger to facilitate using and/or moving the gas spring and/or adjustment assembly.

Yet another aspect is a basketball system that may include a dampener such as a spring or other biasing member. The dampener is preferably sized and configured to assist in adjusting the height of the basketball goal. For example, the dampener may facilitate movement of the basketball goal from a first position to a second position. In particular, the dampener may be used to at least partially counteract the force of gravity to allow the basketball system to be more easily adjusted.

Still another aspect is a basketball system that may include a backboard that is sized and configured to provide enhanced rebounding characteristics. The backboard, for example, may include one or more weights that are sized and configured to add mass to particular portions of the backboard. The weights are preferably located proximate a central portion of the backboard, but the weights may be positioned in other suitable locations. The backboard may also include one or more receiving portions that are sized and configured to at least partially receive the weights or ballast material to increase the mass of the backboard.

Yet another aspect is a basketball system may include a basketball goal with a backboard and a rim. The basketball system may also include a support structure that is sized and configured to support the basketball goal above a playing surface. The support structure may include an elongated support member that is generally vertically disposed relative to the playing surface and a single support assembly which connects the elongated support member to the basketball goal. The single support assembly may include first and second connecting members that connect the elongated support member and the basketball goal. Desirably at least a portion of the second connecting member is disposed within a portion of the first connecting member. In addition, the basketball system may include a height adjustment mechanism to allow the height of the basketball goal to be adjusted.

Advantageously, a portion of the basketball goal, the first connecting member of the single support assembly, a portion of the elongated support member and the second connecting member of the single support assembly may form at least a portion of a four-bar linkage. In addition, the portion of the basketball goal, the first connecting member of the single support assembly, the portion of the elongated support member and the second connecting member of the single support assembly may have a generally parallelogram configuration. These components may also be pivotally connected to form part of a four-pivot linkage, if desired.

These and other aspects, features and advantages of the present invention will become more fully apparent from the following detailed description of preferred embodiments.

BRIEF DESCRIPTION OF THE DRAWINGS

The appended drawings contain figures of preferred embodiments to further clarify the above and other aspects, advantages and features of the invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a basketball system. The principles of the present invention, however, are not limited to basketball systems. It will be understood that, in light of the present disclosure, the basketball systems disclosed herein can be successfully used in connection with other types of sports equipment and/or support structures.

Additionally, to assist in the description of the basketball system, words such as top, bottom, front, rear, right and left may be used to describe the accompanying figures. It will be appreciated, however, that the basketball system can be located in a variety of desired positions and configurations. Further, while the accompanying drawings illustrate exemplary embodiments of the basketball system, the drawings are not necessarily to scale and the basketball system can have other suitable arrangements and configurations.

Please note that the exemplary basketball systems shown in the accompanying figures and described in more detail below may include any suitable combination of features, functions, aspects, components, configurations, etc. The basketball systems may also include other appropriate features, functions, aspects, components, configurations, etc., depending, for example, upon the intended use of the basketball system.

For convenience, some components shown in the accompanying figures and discussed in detail below may have the same reference numbers. It will be appreciated, however, that these and other components of the basketball system may have different shapes, sizes, configurations and the like depending, for example, upon the intended used of the basketball system. A detailed description of the basketball system now follows.

Figure 1:
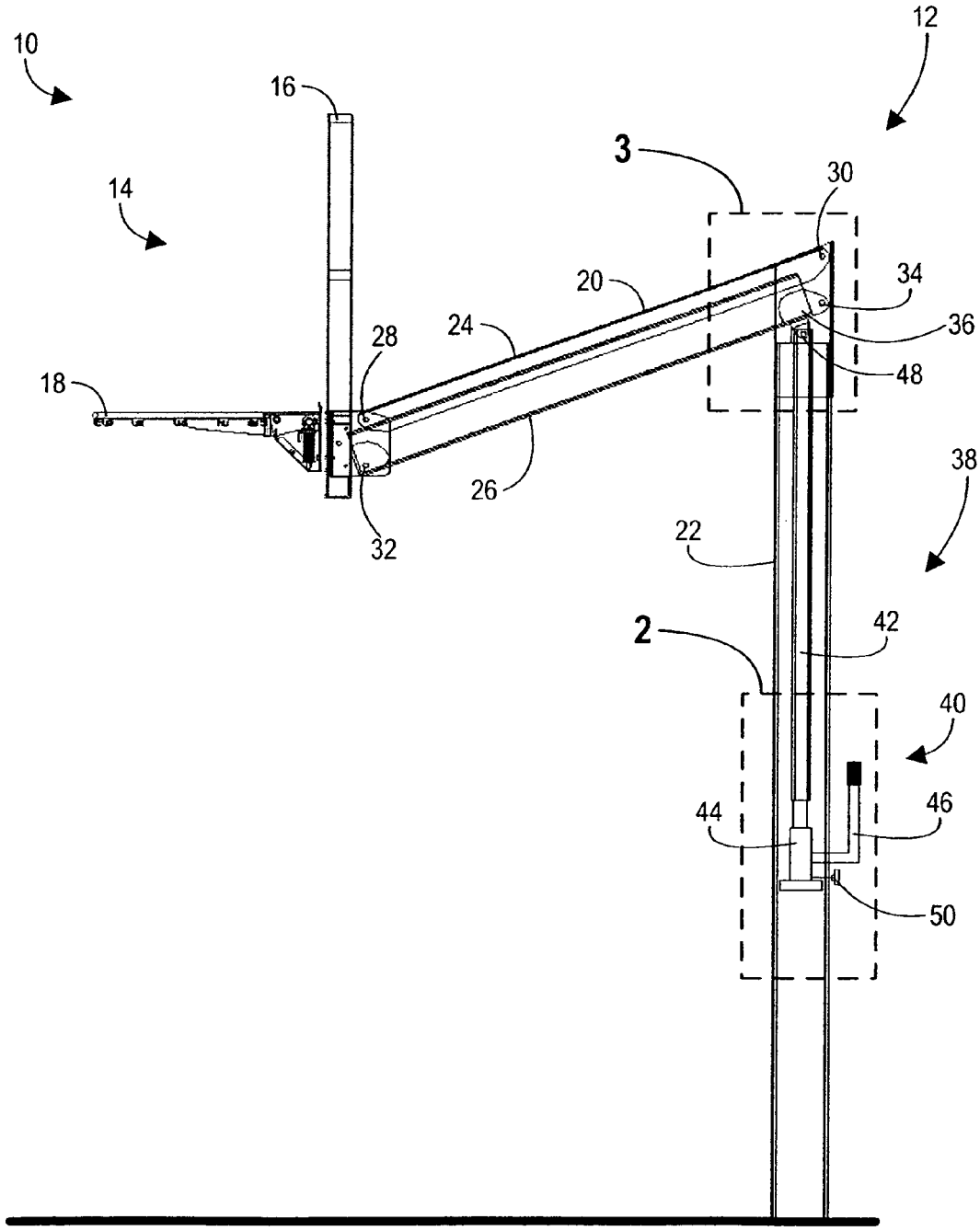
FIG. 1 is a side view of an exemplary basketball system, illustrating a basketball goal at a first height.

As shown in FIG. 1, an exemplary basketball system 10 may include a support structure 12 that is sized and configured to support a basketball goal 14 above a playing surface. The basketball goal 14 preferably includes a backboard 16 and a rim 18, and the basketball goal may also include a net connected to the rim. The basketball backboard 16 may be constructed of plastic, metal, glass or any other suitable materials. If the basketball backboard 16 is constructed from plastic, it may be formed using a blow molding process, an injection molding process or other suitable processes. The rim 18 may be secured in a generally fixed configuration relative to the backboard 16 or the rim may have a displaceable or "break-away" type configuration, if desired.

The support structure 12 is preferably sized and configured to support the basketball goal 14 at a variety of heights. In particular, the support structure 12 may be selectively positioned to support the rim 18 at the standard, regulation height of 10 feet; however, the support structure may be selectively positioned to support the rim at higher and/or lower heights. For example, the support structure 12 may be positioned to support the rim 18 below the standard height to accommodate children that may lack the ability to shoot at a regulation height rim.

In greater detail, as shown in the accompanying figures, the support structure 12 may include one or more support members, such as support members 20, 22. To permit the height of the basketball goal 14 to be adjusted, one or both of the support members 20, 22 are preferably movable. For example, the support member 20 may be movable relative to the support member 22. In greater detail, the support member 22 may remain in a generally fixed position and the support member 20 may be movably connected to the support member 22. In addition, the support member 20 may be movably connected to the basketball goal 14. It will be appreciated that the support structure 12 may have other suitable configurations and arrangements depending, for example, upon the intended use of the basketball system 10.

The support structure 12 is preferably constructed from relatively strong materials such as metal or steel. In particular, the support members 20, 22 are preferably constructed from steel, but the support members and/or support structure may be constructed from other materials with suitable characteristics.

As shown in FIGS. 1, 3, 4, 7 and 8, the support member 20 preferably includes a first portion 24 and a second portion 26. The first portion 24 of the support member 20 preferably comprises a generally U-shaped channel. The second portion 26 of the support member 20 preferably comprises a generally square-shaped tubular member. The generally U-shaped channel of the first portion 24 and the tubular configuration of the second portion 26 may advantageously help provide a torsion resistance configuration, but these components may have other suitable shapes and configurations. The first portion 24 is preferably sized and configured to receive at least a portion of the second portion 26, which may create the appearance of a unitary, one-piece support member 20. In particular, the second portion 26 is preferably completely, substantially or at least partially disposed within the first portion 24 to help create the appearance of a single support member. Advantageously, this may help create a pleasing appearance and aesthetic design. It will be appreciated that the first and second portions 24, 26 may have other suitable configurations and arrangements such as the first portion 24 being at least partially disposed within the second portion 26. It will also be appreciated that the support member 20 may have other configurations and arrangements depending, for example, upon the intended use of the basketball system 10. For instance, the support member 20 does not require a multi-piece construction and may have a unitary, one-piece construction if desired.

The first portion 24 of the support member 20 may include a first end 28 that is pivotally or otherwise movably connected to the basketball goal 14 and a second end 30 that is pivotally or otherwise movably connected to the support member 22. The second portion 26 may include a first end 32 that is pivotally or otherwise movably connected to the basketball goal 14 and a second end 34 that is pivotally or otherwise movably connected to the support member 22. A bracket 36 may be used to help connect the second portion 26 of the support member 20 to the support member 22. As discussed above, it will be appreciated that the support structure 12 may have other suitable arrangements and configurations. For example, the first and second portions 24, 26 of the support member 20 may have a generally square, circular, or other suitable shapes and/or configurations; and the support member 20 and the basketball goal 14 may be connected using various suitable brackets, connectors, fasteners, adhesives and the like.

Figure 4:
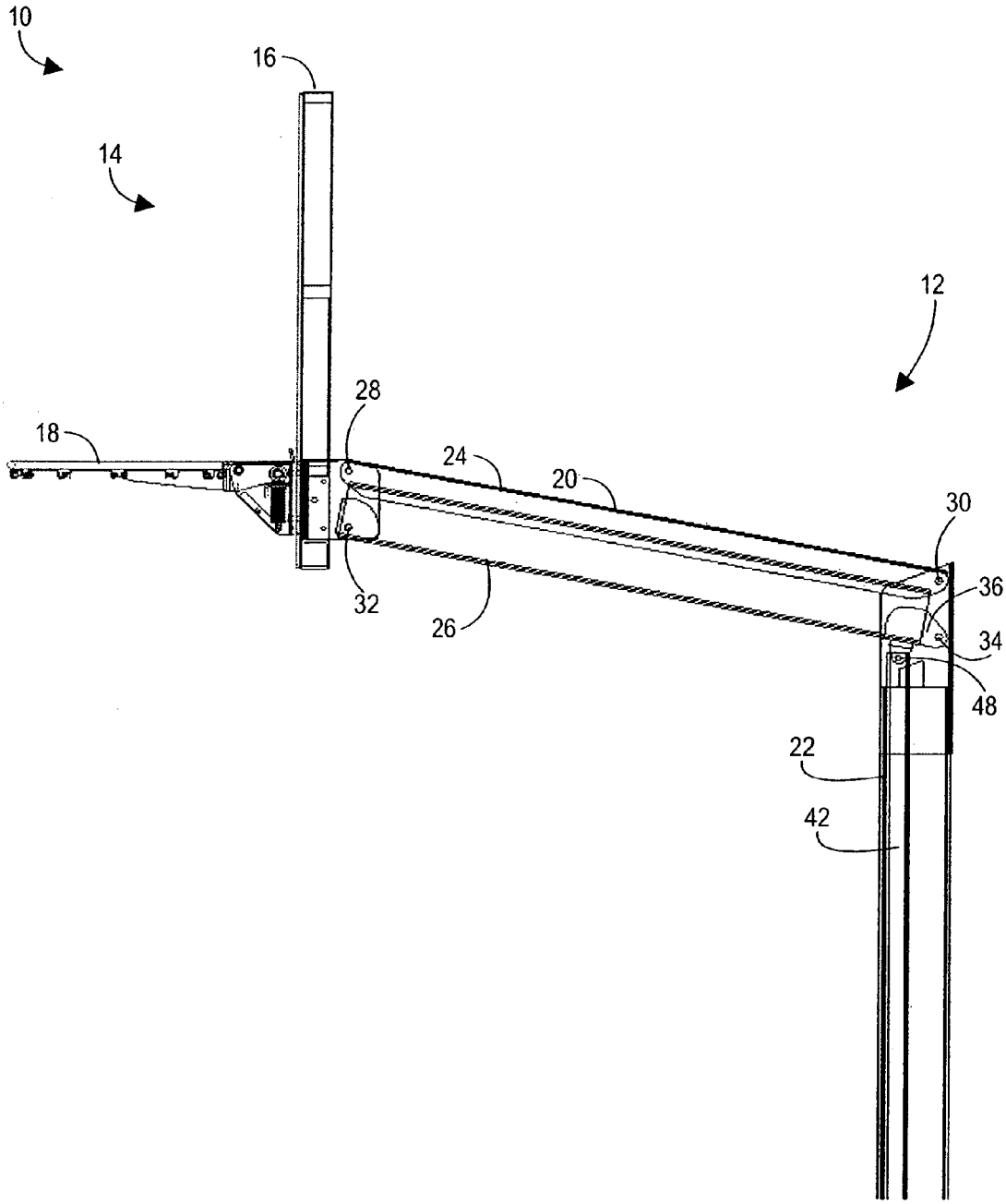
FIG. 4 is still another enlarged side view of a portion of the basketball system shown in FIG. 1, illustrating the basketball goal at a second height.
Figure 5:
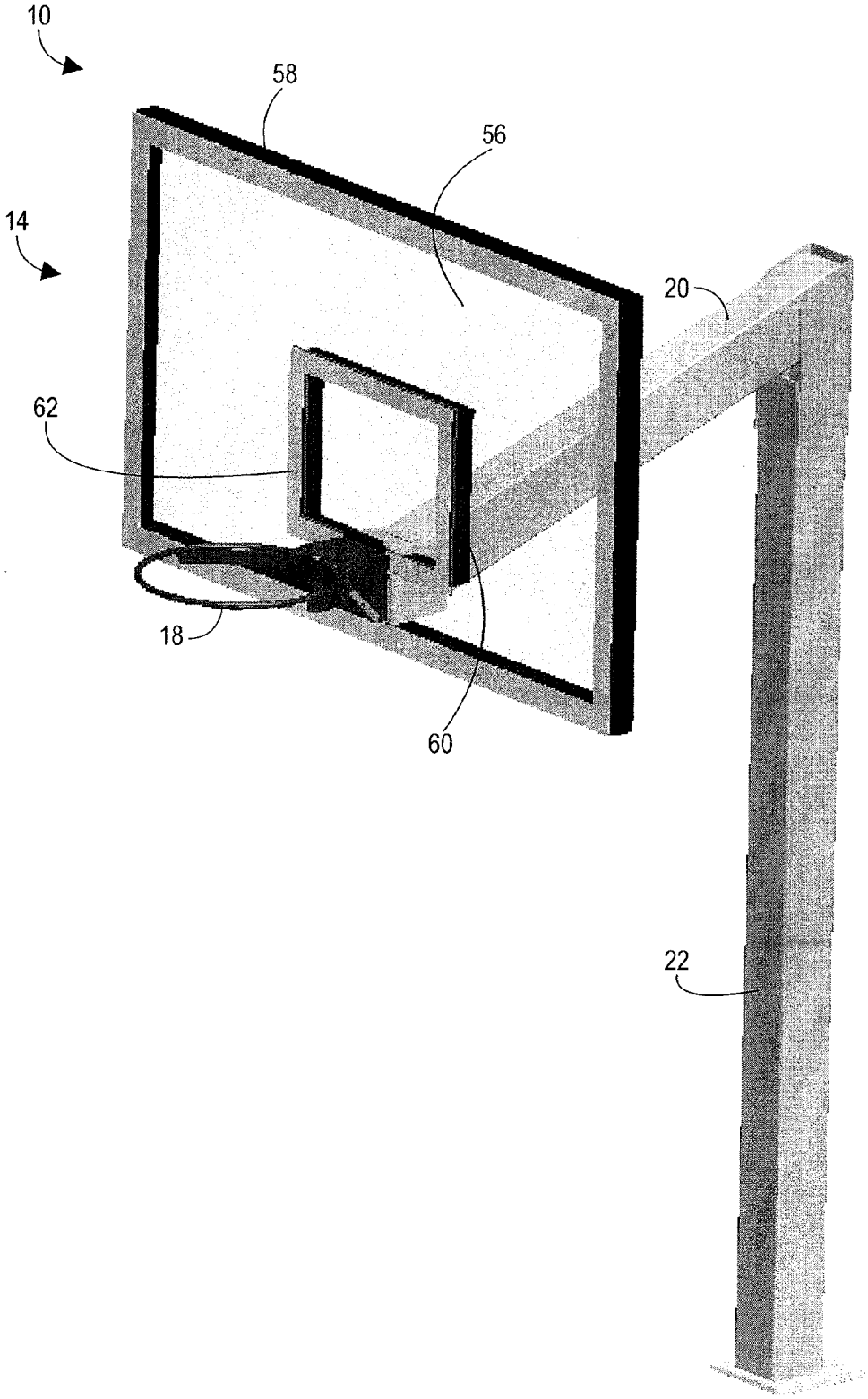
FIG. 5 is a front perspective view of another exemplary basketball system, illustrating an exemplary a weight or mass which may be used in connection with the basketball system and the weight or mass may be sized and configured to enhance the rebounding characteristics of a backboard.

As shown in FIGS. 1 and 4, the support structure 12 is preferably sized and configured to support the basketball goal 14 at a variety of heights, while positioning the backboard 16 in a generally vertical orientation and the rim 18 in a generally horizontal orientation relative to the playing surface. To help position the backboard 16 in a generally vertical orientation and the rim 18 in a generally horizontal orientation, the first and second portions 24, 26 of the support member 20 may be pivotally connected to the basketball goal 14 and the support member 22 in a generally parallelogram-shaped configuration. The first and second elongated members 24, 26 may be connected to the basketball goal 14 and the second support member 24 to form part of a four-bar and/or four-pivot linkage.

In greater detail, the generally parallelogram-shaped configuration may include a first side disposed between the ends 28, 30 of the first portion 24 of the support member 20; a second side extending between the ends 30 and 34; a third side extending between the ends 32, 34 of the second portion 26 of the support member 20; and a fourth side extending between the ends 28 and 32. The first and third sides are preferably generally parallel, and the second and fourth sides are generally parallel. With the portions 28, 30, 32 and 34 of the support member 20 pivotally connected in a generally parallelogram-shaped configuration, the support member may be quickly and easily moved to various positions in which the backboard 16 is in a generally vertical orientation and the rim 18 is in a generally horizontal orientation as shown in FIGS. 1 and 4.

The support structure 12 could also include the ends 28, 30, 32 and 34 of the first and second portions 24, 26 of the support member 20 pivotally connected to the basketball goal 14 and the second support member 22, respectively, to form a four-pivot linkage. In addition, the support structure 12 could include the first elongated member 24, the second elongated member 26, a portion of the basketball goal 14 and a portion of the second support member 22 disposed in the configuration of a four-bar linkage. Advantageously, these configurations may allow the support structure 12 and/or support members 20, 22 to be quickly and easily moved. This may allow the height of the basketball goal 14 to be quickly and easily adjusted. Significantly, when the height of the basketball goal 14 is adjusted, the backboard 16 may be disposed in a generally vertical orientation and the rim 18 may be disposed in a generally horizontal orientation relative to the playing surface.

It will be appreciated that the support member 20 need not be pivotally or movably connected to the basketball goal 14 and the support member 22. It will also be appreciated that the support member 20 does not require a generally parallelogram-shaped connection. Further, it will be appreciated that the backboard 16 and rim 18 may be positioned in other orientations to, for example, facilitate storage. Further, the basketball goal 14 and the support structure 12 may have other suitable shapes, sizes, configurations and arrangements depending, for example, upon the intended use of the basketball system 10.

As shown in FIG. 1, to help support the basketball goal 14 at a variety of heights, the basketball system 10 may include an adjustment assembly 38. The adjustment assembly 38, for example, may be sized and configured to move the support structure 12 to adjust the height of the basketball goal 14. In greater detail, the adjustment assembly 38 may move the first support member 20 relative to the second support member 22 to allow the height of the basketball goal 14 to be adjusted.

As shown in FIGS. 1-4, the adjustment assembly 38 preferably includes a jack 40 which may include an arm 42, a base 44 and a handle 46. The arm 42 is preferably pivotally or otherwise movably connected to the support member 20 using the bracket 36. The handle 46 of the jack 40 may be used to manipulate the distance between the base 44 and an end 48 of the arm 42 that is connected to the bracket 36. By manipulating the distance between the base 44 and the end 48, the handle 46 may manipulate the support member 20 to adjust the height of the basketball goal 14. For example, as the distance between the base 44 and the end 48 increases, the support member 20 may pivot or otherwise moves upwardly to increase the height of the basketball goal 14. As the distance between the base 44 and the end 48 decreases, the support member 20 may pivot or otherwise move downwardly to decrease the height of the basketball goal 14. It will be appreciated that the jack 40 may be any suitable type of jack such as a mechanical jack, a hydraulic jack, etc. It will also be appreciated that the jack 40 could be any suitable type of structure that is capable of moving the support member 20 into the desired position.

Figure 2:
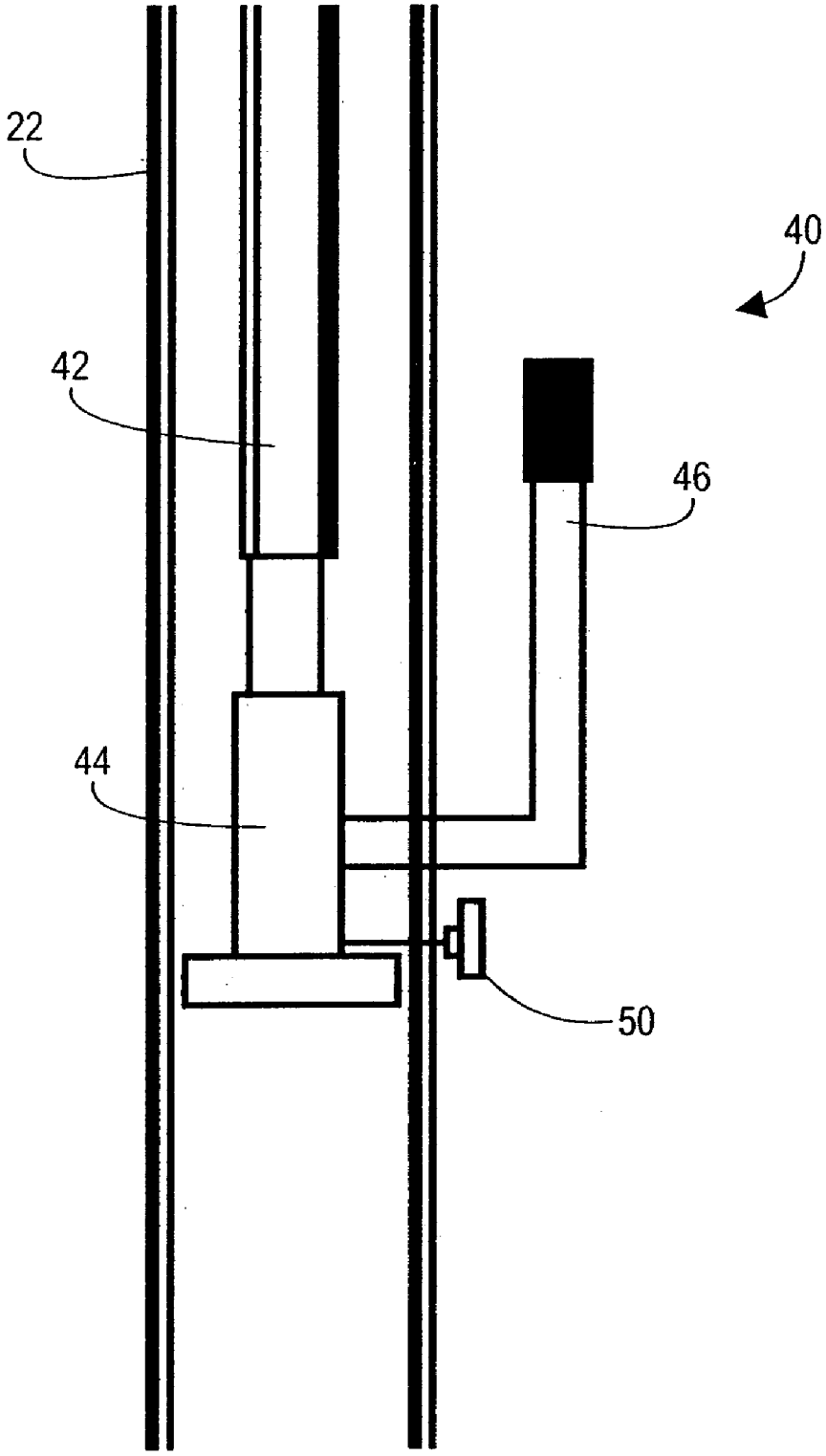
FIG. 2 is an enlarged side view of a portion of the basketball system shown in FIG. 1.

As shown in FIGS. 1 and 2, the jack 40 may include a release, handle or trigger 50 that releases the jack. For example, the trigger 50 may permit the arm 42 to move from one position to another position. In greater detail, when the trigger 50 is depressed, the handle 46 may be used to lower and/or raise the arm 42 to a desired position.

The trigger 50 may also be used, for example, to help control the movement of the basketball goal 14. For instance, the trigger 50 may include one or more dampeners, springs, biasing members or the like that are sized and configured to control the movement of the basketball goal 14. The trigger 50 may allow the user to more easily adjust the height of the basketball goal 14 by, for example, slowing the movement of the basketball goal and/or providing a counter-balancing force. In greater detail, the trigger 50 may be used to allow the arm 42 to return relatively slowly to a position, such as a lower portion, and that may allow the basketball goal to return relatively slowly to a different height, such as a lower height. In this example, the dampener may at least partially counters the force of gravity and that may make it easier to increase and/or decrease the height of the basketball goal 14. It will be appreciated that the dampener may be connected to the support members 20, 22; the support structure 12, and/or any other suitable portions of the basketball system 10.

Figure 3:
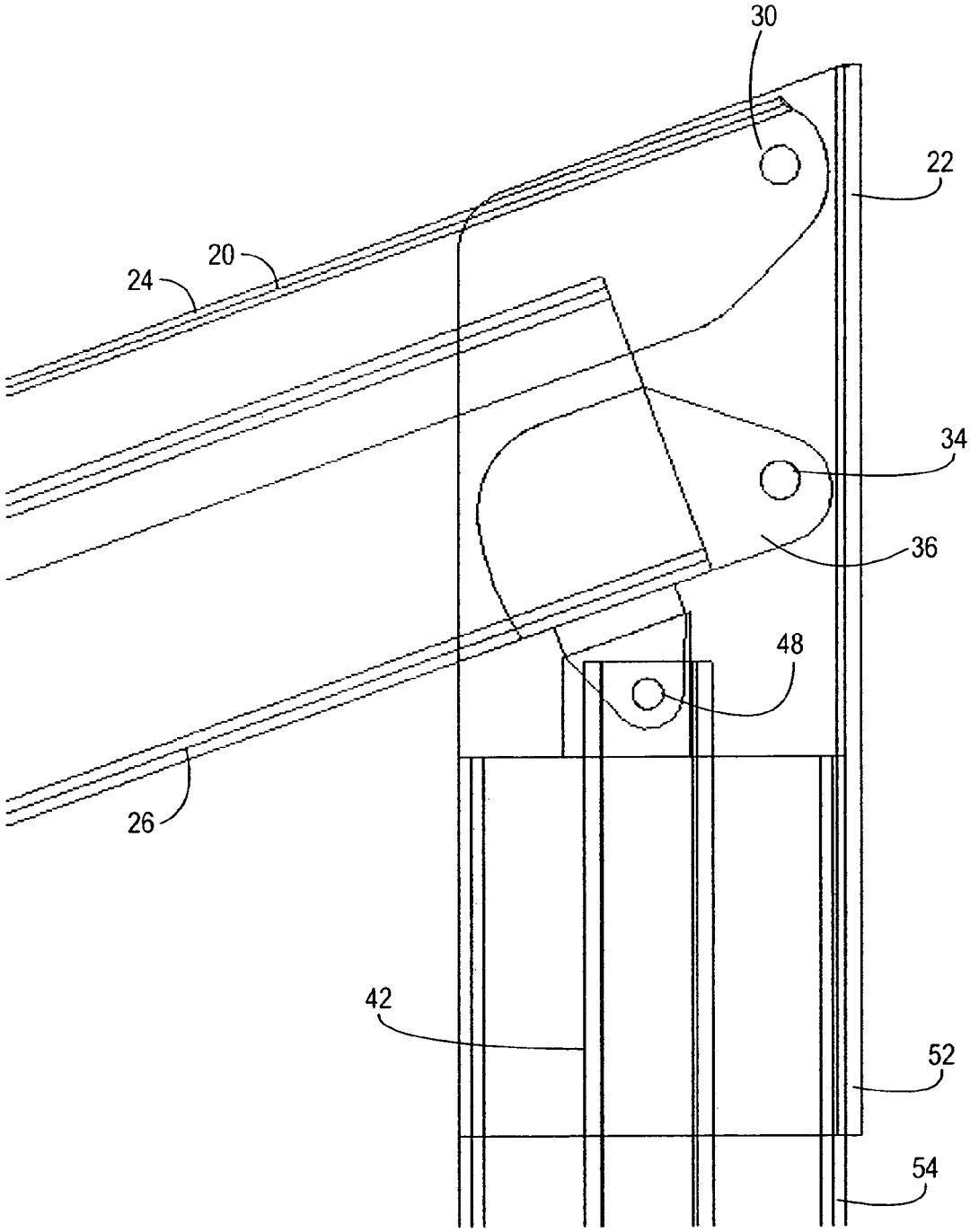
FIG. 3 is another enlarged side view of another portion of the basketball system shown in FIG. 1.

As shown in FIG. 3, the support member 22 may include a first portion 52 and a second portion 54. The first portion 52 may consist of a generally square-shaped tubular member and the second portion 54 may also consist of a generally square-shaped tubular member. The first portion 52 is preferably sized and configured to receive at least a portion of the second portion 54. In addition, the bracket 36 is preferably connected to the tubular member 52, which may allow the basketball system 10 to be more easily assembled. While the tubular members 52, 54 of the support member 22 preferably have a generally square shaped configuration, the tubular members may have other suitable configurations such as circular, oval, rectangular and the like depending, for example, upon the shape and configuration of the support member 22. One of ordinary skill in the art will appreciate that these and other portions of the basketball system 10 may have other suitable shapes, sizes and/or configurations depending, for example, upon the intended use of the basketball system. One of ordinary skill in the art will also appreciate that these and other portions of the basketball system 10 may consist of unitary, one-piece components or components that include multiple pieces or parts.

As shown in FIGS. 1-4, the basketball system 10 may include a backboard 16 that is attached to the support structure. The backboard 16 may be a conventional backboard that is constructed from materials such as glass, metal and/or plastic. The backboard may consist of a unitary, one-piece structure or it may include two or more components. For example, the backboard 16 may include a frame and a rebound member connected to the frame. The frame may be constructed from a relatively strong and durable material such as metal or plastic, and the rebound member may be constructed from acrylic or another suitable material. The backboard 16 may have a generally rectangular configuration, such as shown in the accompanying drawings, and it may have a width of about four or five feet, or it may have other appropriate shapes and sizes.

The basketball system 10 may also be sized and configured to enhance the rebounding characteristics of the system. For example, as best seen in FIGS. 5-9, the basketball system 10 may include one or more weights or other structures that are sized and configured to enhance the rebounding characteristics of the system. In particular, the basketball system 10 may include a backboard 56 and a generally centrally located weight 60 that is sized and configured to provide enhanced rebounding characteristics. In particular, the weight 60 may provide increased mass proximate the central portion of the backboard 56 and that may enhance the rebounding characteristics of the basketball system 10. The weight 60 may also tend to keep all or a portion of the backboard 56 and/or the support structure 12 in a generally stationary position so that the basketball rebounds in a more consistent manner. In addition, the weight 60 may help prevent all or a portion of the backboard 56 and/or the support structure 12 from moving when a basketball or other object strikes the basketball system 10.

The weight 60 may be constructed from metal (such as steel) or other relatively heavy material. For example, the weight 60 may consist of a metal frame that is disposed proximate the central portion of the backboard 56. As shown in the accompanying figures, the weight 60 may be spaced apart from the outer frame 58 of the backboard 56 and the weight 60 may be directly connected to the support member 20 of the support structure 12. In this configuration, the weight 60 may be substantially supported by the support structure 12 and not the backboard 56. It will be appreciated, however, that the weight 60 can be directly or indirectly connected to any suitable portions of the backboard 56, support structure 12 and/or basketball system 10.

Advantageously, the weight 60 may be selectively and/or removably attached to the basketball system 10, which may facilitate shipping of the basketball system. In addition, the weight 60 may be increased and/or decreased as desired depending, for example, upon the intended use of the basketball system 10. For instance, the backboard 56 and/or the support structure 12 may include one or more receiving portions that are sized and configured to receive the weight 60. Thus, the receiving portions could be filled with the desired amount of ballast material, such as water, sand, gravel or the like.

The weight 60 is desirably positioned near the center of the backboard 56, which may help prevent the backboard from moving when a basketball contacts this portion of the backboard. In particular, the increased mass may help the backboard 56 remain in a generally fixed position and/or it may help decrease the amount that the backboard moves when a force is applied to the backboard. Advantageously, because basketballs most often strike the backboard 56 proximate the rim 18, which is typically located near the center of the backboard, that may provide a backboard with enhance rebounding characteristics. The backboard 56 may also be used in connection with other weights and/or the weights could be disposed in other locations. For example, the upper portion, lower portion and/or sides of the backboard 56 may also include one or more weights and/or be sized and configured to receive ballast material.

In greater detail, the backboard 56 may include a rebound member that is attached to the frame 58 and the rebound member may be constructed of a generally transparent or generally translucent material. The generally transparent or generally translucent rebound member may provide the appearance of basketball backboards used in professional and collegiate games. It will be appreciated, however, that the rebound member does not have be transparent or translucent.

The backboard 56 may also include a target 62, which is typically positioned slightly above the rim 18. The target 62 is typically positioned to facilitate shooting at the rim 18 and it may be painted or silk-screened on the rebound member. It will be appreciated that the target 62 may also be integrally formed as part of the backboard 56 or the target may be attached to the backboard 56 in any suitable fashion. Significantly, the weight 60 may be positioned behind a target 62 so that it is generally not visible to players using the basketball system 10. This may create a pleasing appearance or design because the weight 60 may be generally hidden from view. This may also allow a basketball backboard 56 with enhanced rebounding characteristics to be created but with the appearance of a conventional basketball backboard.

The weight 60 and the target 62 may also be part of the same structure. For example, the weight 60 could form all or a part of the target 62. In particular, the weight 60 could have the size and shape of the target 62 and the weight could be positioned to eliminate the need for a separate target. This may facilitate manufacturing of the basketball system 10 because the weight 60 and the target 62 could be part of the same structure. It will be understood, however, that the weight 60 and the target 62 could be separate structures that could be formed by any desired number of components or parts.

Figure 10:
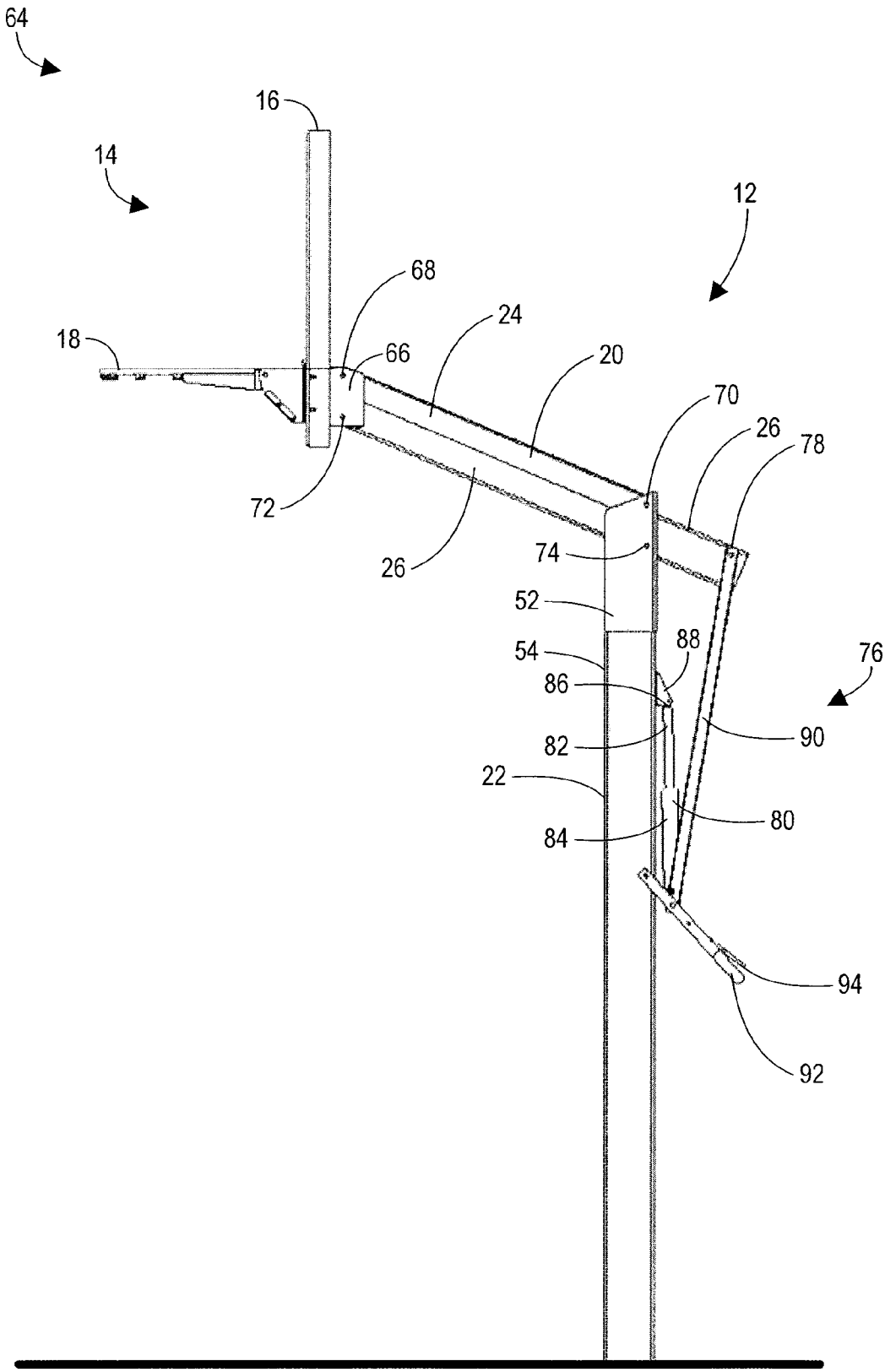
FIG. 10 is a side view of still another exemplary basketball system.
Figure 11:
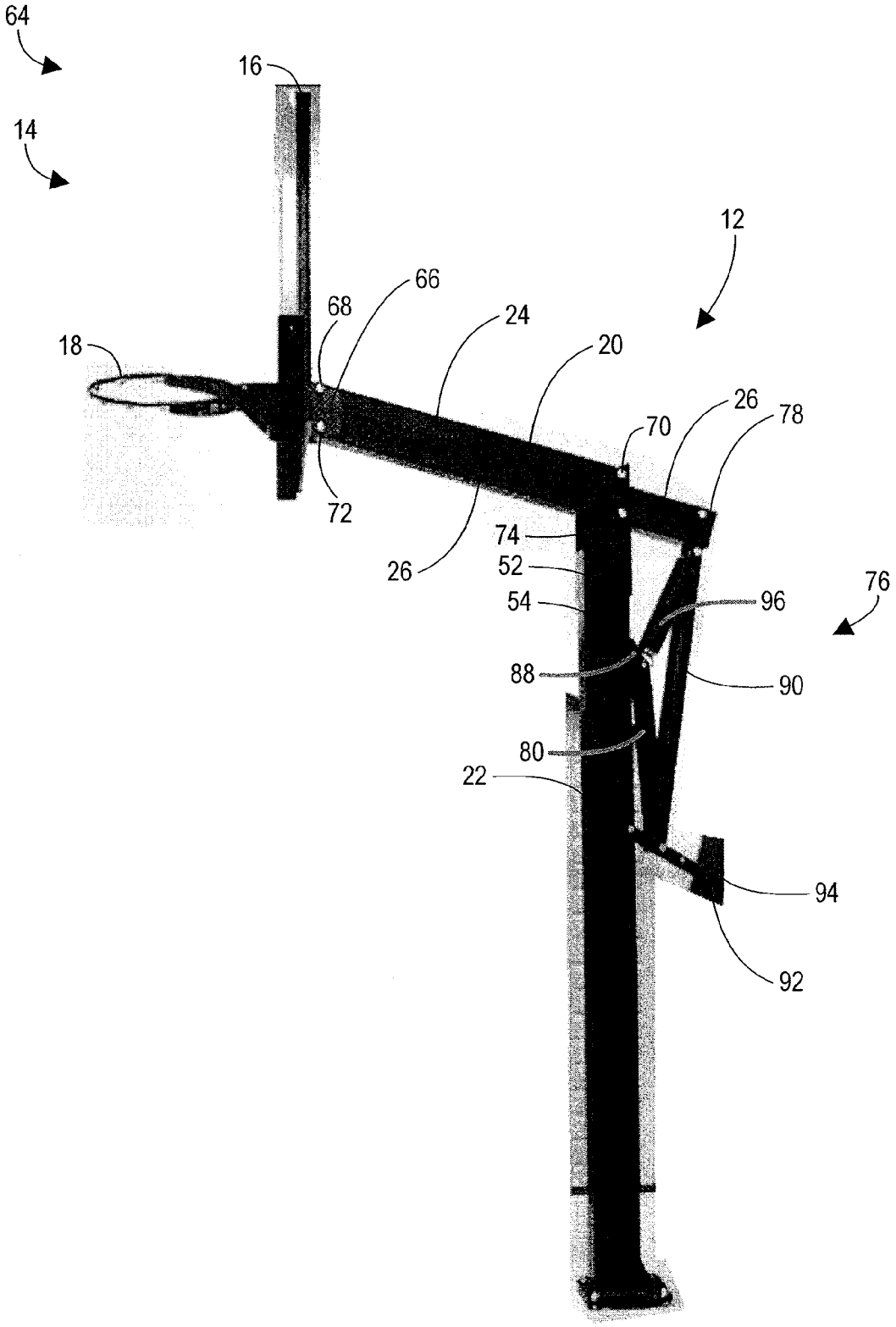
FIG. 11 is a side view of the basketball system shown in FIG. 10, illustrating the basketball system with an exemplary dampener.

As discussed above, the basketball system may have other suitable features, configuration, arrangements and the like. For example, as shown in FIGS. 10-13, another exemplary basketball system 64 may include a support structure 12 and a basketball goal 14 that is similar to that discussed above. For example, the basketball goal system 64 may include a support structure 12 and basketball goal 14 with a backboard 16, a rim 18, a first support member 20, a second support member 22, a first elongated portion 24 and a second elongated portion 26 in a generally similar configuration as discussed in connection with the basketball system 10. As best shown in FIGS. 10 and 11, the second support member 22 may include a first portion 52 and a second portion 54. In addition, a bracket 66 may be used to help connect basketball goal 14 to the support member 22, a first fastener 68 may be used to connect the bracket to the first elongated member 24, a second fastener 70 may be used to connect the first elongated member to the support member 22, a third fastener 72 may be used to connect the second elongated member 26 to the bracket, and a fourth fastener 74 may be used to connect the second elongated member to the support member.

The support structure 12 of the basketball system 64 is preferably sized and configured to support the basketball goal 14 at a variety of heights, while positioning the backboard 16 in a generally vertical orientation and the rim 18 in a generally horizontal orientation. To help position the backboard 16 in a generally vertical orientation and the rim 18 in a generally horizontal orientation, these components may help create a structure with a generally parallelogram-shaped connection. In addition, these components may help create a structure with a four pivot and/or bar linkage.

The basketball system 64 may include a height adjustment assembly 76 that is sized and configured to help adjust the height of the basketball goal 14. For example, the adjustment assembly 76 may be sized and configured to bias and/or move the second portion 26 of the support member 20 into the desired position. In particular, the adjustment assembly 76 may allow the second portion 26 of the support member 20 to act as a lever to raise or lower the basketball goal 14. For instance, the adjustment assembly 76 may be used to apply a generally downward force to an end 78 of the second elongated portion 26, which may cause the elongated member to pivot about the fastener 74 and lift the basketball goal 14 in a generally upward direction. Also, the adjustment assembly 76 may be used to lower the basketball goal 14.

The adjustment assembly 76 preferably includes a biasing member 80, such as a spring. In particular, the biasing member 80 may include one or more pneumatic gas springs, pressure-loaded springs or the like. Preferably, the biasing member 80 helps provides a counterbalance force that at least partially counters the force of gravity against the basketball goal 14 and/or the support member 20. In particular, as best seen in FIGS. 10-11, the biasing member 80 may include an arm 82 and a base 84. A portion 86 of the arm 82 is preferably pivotally or otherwise movably connected to the support member 22 using a bracket 88. The biasing member 80 preferably is configured to provide a force that extends the arm 82 and the base 84 away from each other, such that the distance between the base 84 and the portion 86 connected to the support member 22 increases. As the distance between the base 84 and the portion 86 of the arm 82 connected to the support member 22 increases, the biasing member 80 may exert a generally downward force against at least a portion of the arm 90. With a generally downward oriented force exerted against the arm 90, the arm 90 may exert a generally downward oriented force against the portion 78 of the tubular member 26, which provides a counterbalance force to at least partially counter the force of gravity against the basketball goal 14 and/or the support member 20.

The adjustment assembly 76 may include a handle 92 and a trigger 94 that is sized and configured to help adjust the height of the basketball goal 14. In particular, the handle 92 and the trigger 94 may be sized and configured to manipulate the distance between the base 84 and the portion 86 of the arm 82 that is connected to the bracket 88. When manipulating the distance between the base 84 and the portion 86, the handle 92 and the trigger 94 may allow the height of the basketball goal 14 to be adjusted. For example, as the distance between the base 84 and the portion 86 increases, the biasing member 80 may exert a generally downward force against at least a portion of the arm 90. By exerting a generally downward force against the arm 90, the arm 90 may exert a generally downward force against the portion 78 of the tubular member 26, which causes the tubular member to pivot about the fastener 74 and lift the basketball goal 14 in a generally upward direction. In addition, as the distance between the base 84 and the portion 86 decreases, at least a portion of the generally downward oriented force applied to the portion 78 is removed, which causes the tubular member to pivot about the fastener 74 as gravity lowers the basketball goal 14 in a generally downward direction.

Advantageously, the biasing member 80 may be selectively locked and unlocked in a plurality of positions using, for example, the handle 92 and the trigger 94. In particular, the handle 92 and the trigger 94 may be used to selectively lock the arm 82 and the base 84 of the biasing member 80 in one or more relative positions, which may allow the basketball goal 14 to be selectively locked at a plurality of corresponding heights. For example, the trigger 94 may be activated to unlock the biasing member 80, allowing the handle 92 to be used to move the arm 82 and the base 84 to any of a plurality of relative positions. When the arm 82 and the base 84 are in a desired relative position, the trigger 94 may deactivated to lock the biasing member 80 at the desired relative position.

Preferably, the arm 82 and the base 84 of the biasing member 80 may be selectively locked in any of a substantially continuous range of positions, which may allow the basketball goal 14 to be selectively locked at any of a substantially continuous range of heights. However, depending upon the particular configuration of the basketball system, the arm 82 and the base 84 of the biasing member 80 may be selectively locked in one or more discrete, discontinuous positions, which may allow the basketball goal 14 to be selectively locked at one or more discrete, discontinuous corresponding heights.

It will be appreciated that the adjustment assembly 76 and the biasing member 80 may have a variety of suitable configurations and arrangements. For example, it will be appreciated that a biasing member 80 may include a spring, a jack or other suitable type of structure. Additional information regarding adjustment assemblies, biasing members and other components, features and the like that may be used in connection with the basketball system 10, 64 may be disclosed in U.S. Pat. Nos. 5,695,417; 5,879,247; 6,077,177; 6,120,396; 6,155,938; 6,135,901; 6,142,891; 6,273,834; 6,419,597; 6,419,598; 6,402,644; 6,422,957; 6,645,095; 6,699,146; each of which are incorporated by reference in their entireties.

As shown in FIG. 11, the adjustment assembly 76 may include a second biasing member 96. The second biasing member 96, which may be a spring, dampener and the like, may be sized and configured to control the movement of the basketball goal 14. For example, the biasing member 96 may allow the user to more easily adjust the height of the basketball goal by slowing the movement of the basketball goal 14 and/or providing a counter-balancing force. In greater detail, the biasing member 96 may be used to allow at least a portion of the second elongated member 26 to return relatively slowly to a lower position and, consequently, allow the basketball goal 14 to return relatively slowly to a lower height. In this example, the biasing member 96 may at least partially counter the force of gravity and that may make it easier to increase and/or decrease the height of the basketball goal. It will be appreciated that the biasing member 96 may be connected to other suitable portions of the basketball system 10. It will also be appreciated that the basketball system 64 can include any suitable number, arrangement, configuration, etc. of biasing members.

Figure 9:
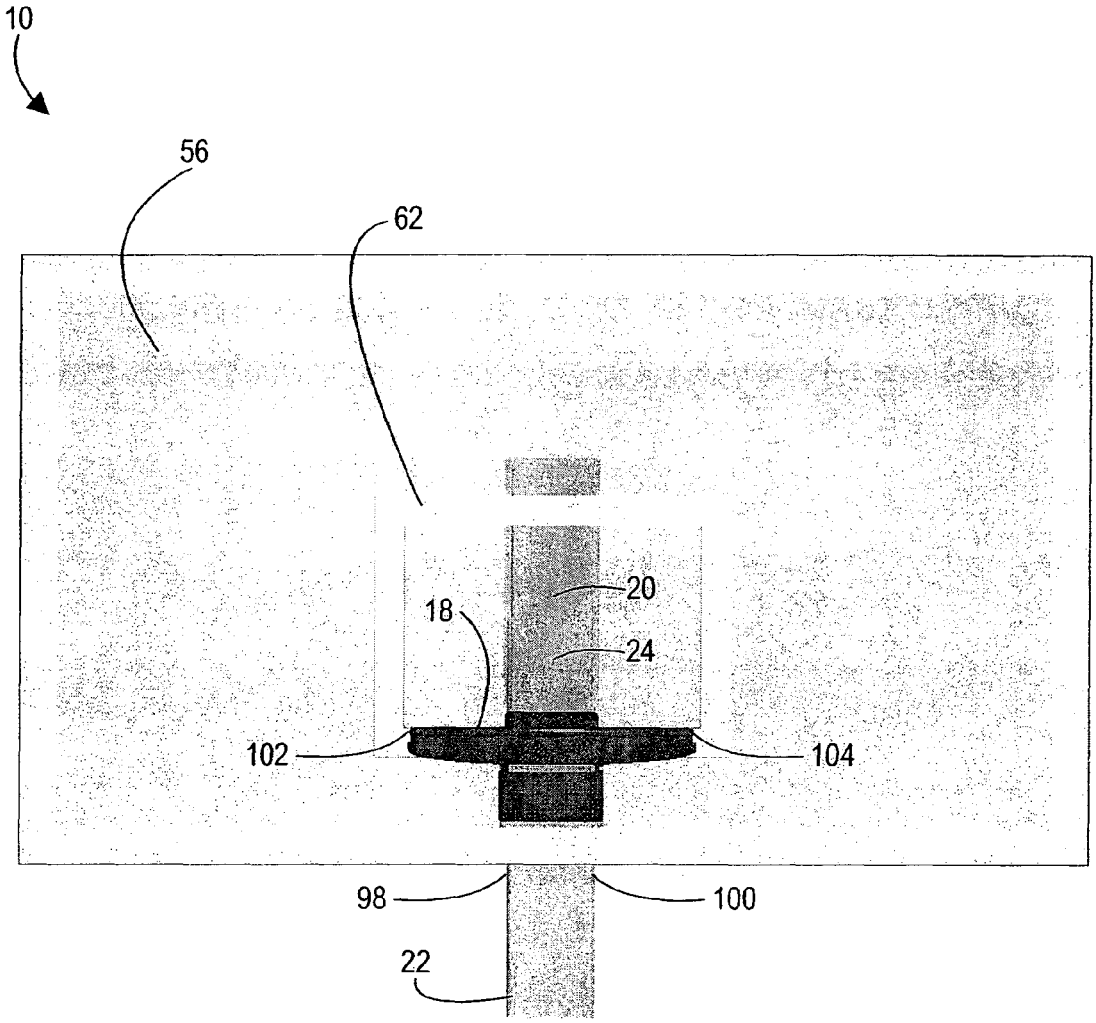
FIG. 9 is a front view of a portion of the basketball system shown in FIG. 5.
Figure 12:
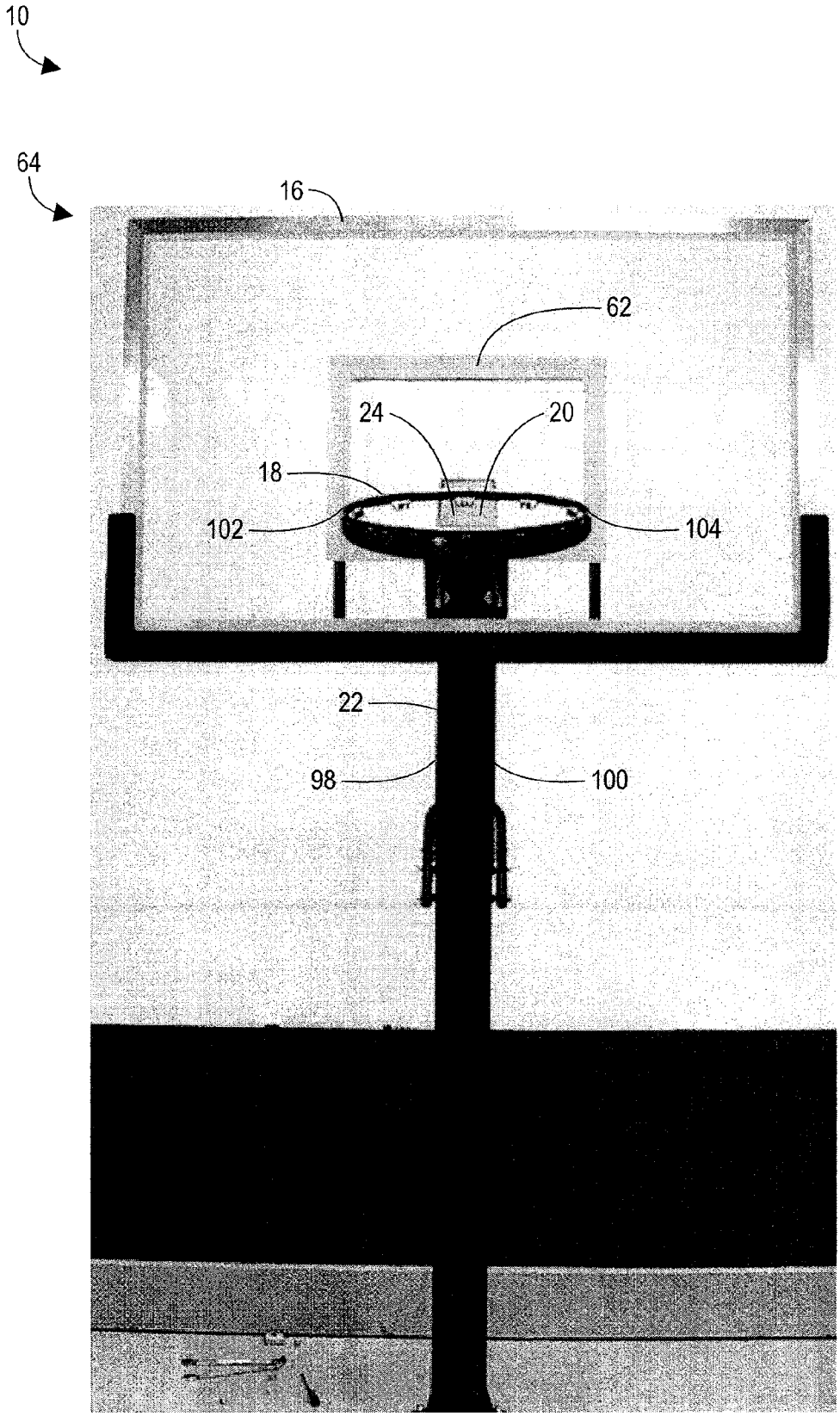
FIG. 12 is a front view of the basketball system shown in FIG. 10.

As shown in FIGS. 9 and 12, the support structure 22 of the basketball systems 10, 64 may include a left side portion 98 and a right side portion 100. The left and right side portions 98, 100 preferably have a generally flat configuration; however, the left and right side portions have a generally curvilinear or other suitable configuration. These left and right side portions 98, 100 may help connect the height adjustment assemblies 38, 76 and/or biasing members to the support structure 12.

The basketball systems 10, 64 may also include a streamlined support structure 12 with a portion of the support member 20 that is sized and configured to be positioned generally between the opposing right and left side portions 98, 100 of the support member 22. Preferably, at least a substantial portion of the support member 22 is positioned generally between the portions 98, 100. In particular, at least a portion of the first elongated member 24 of the support member 20 may be sized and configured to be positioned generally between the portions 98, 100; and at least a portion of the second elongated member 26 of the support member 20 may be sized and configured to be positioned generally between the portions 98, 100. Preferably, at least a substantial portion of the first elongated member 24 is positioned generally between the portions 98, 100; and at least a substantial portion of the second elongated member 26 is positioned generally between the portions 98, 1 00. It will be appreciated, however, that the support structure 12 could have other suitable arrangements and configurations depending, for example, upon the intended use of the basketball system 10.

As shown in the accompanying figures, the rim 18 may include a left side portion 102 and an opposing right side portion 104. The left and right side portions 102, 104 of the rim 18 preferably have a generally curvilinear or other suitable configuration. In addition, the support structure 12 may include a portion of the support member 20 that is sized and configured to be positioned generally between the opposing portions 102, 104 of the rim 18. Preferably, at least a substantial portion of the support member 22 is positioned generally between the left and right side portions 102, 104 of the rim 18. In particular, at least a portion of the first elongated member 24 of the support member 20 is sized and configured to be positioned generally between the left and right side portions 102, 104 of the rim 18; and at least a portion of the second elongated member 26 of the support member 20 is sized and configured to be positioned generally between the left and right side portions 102, 104 of the rim. Preferably, at least a substantial portion of the first elongated member 24 is positioned generally between the portions 102, 104; and at least a substantial portion of the second elongated member 26 is positioned generally between the portions 102, 104. It will be understood that the rim 18 and the support structure could have other suitable arrangements and configurations depending, for example, upon the intended use of the basketball system 10.

The basketball systems 10, 64 may also include a streamlined support structure 12 in which the first elongated member 24 of the first support member 20 is sized and configured to receive at least a portion of the second elongated member 26 of the first support member 20. In addition, at least a portion of the second elongated member 26 may be disposed generally underneath and/or lower than the first elongated portion 24.

Advantageously, the streamlined support structure 12 may require less material for construction. Also, the more streamlined support structure 12 may include fewer parts and may be less complicated for consumers to assemble. Further, the more streamlined support structure may be more freely installed and/or moved because it may lack larger, more awkward parts that can limit the installation and movement of the support structure. In addition, the streamlined support structure 12 may create a pleasing aesthetic appearance and facilitate different types of basketball systems with various designs and configurations. As indicated above, however, the support structure 12 could have other suitable arrangements and configurations depending, for example, upon the intended use of the basketball system 10

Figure 6:
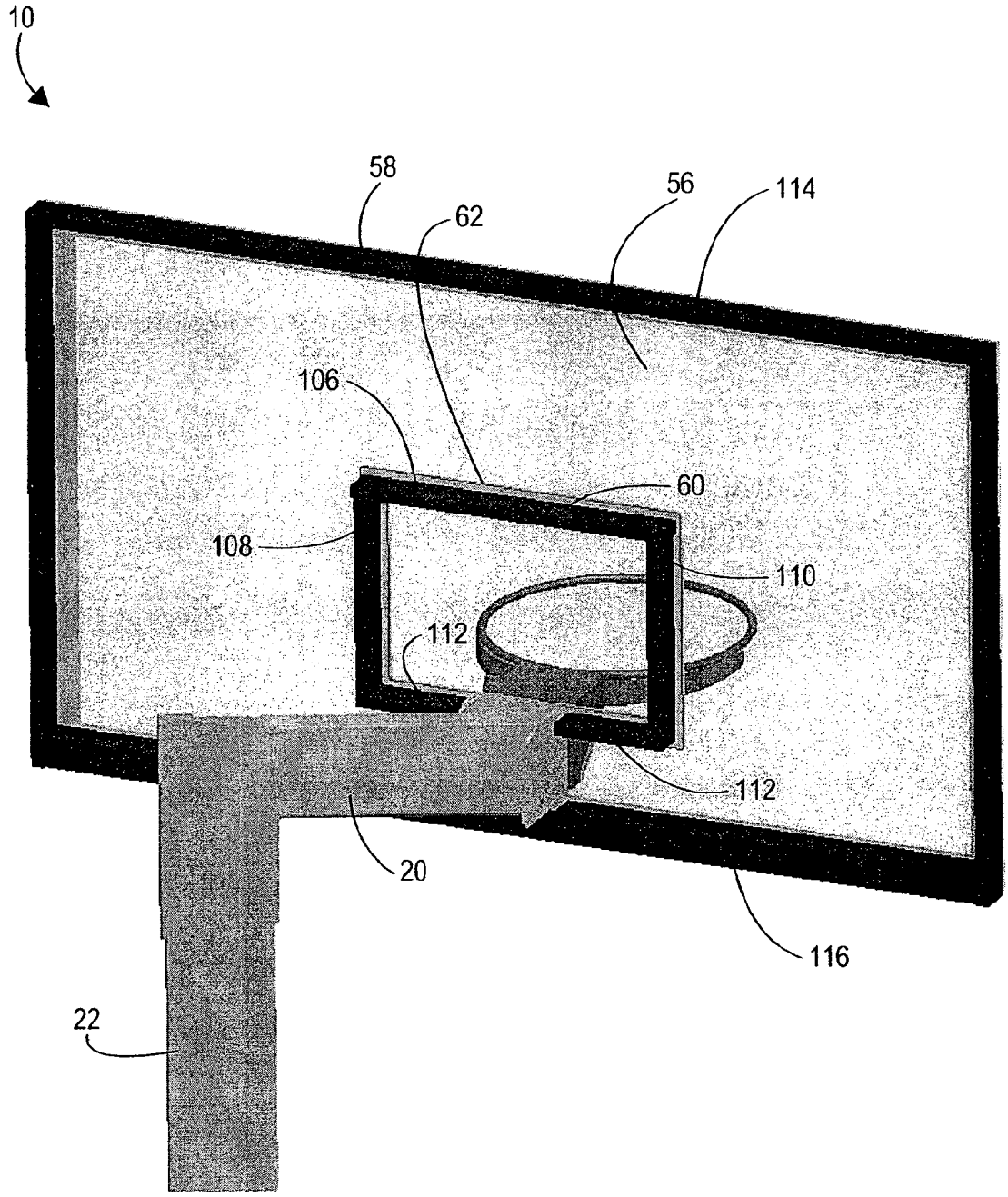
FIG. 6 is an enlarged rear perspective view of a portion of the basketball system shown in FIG. 5.
Figure 7:
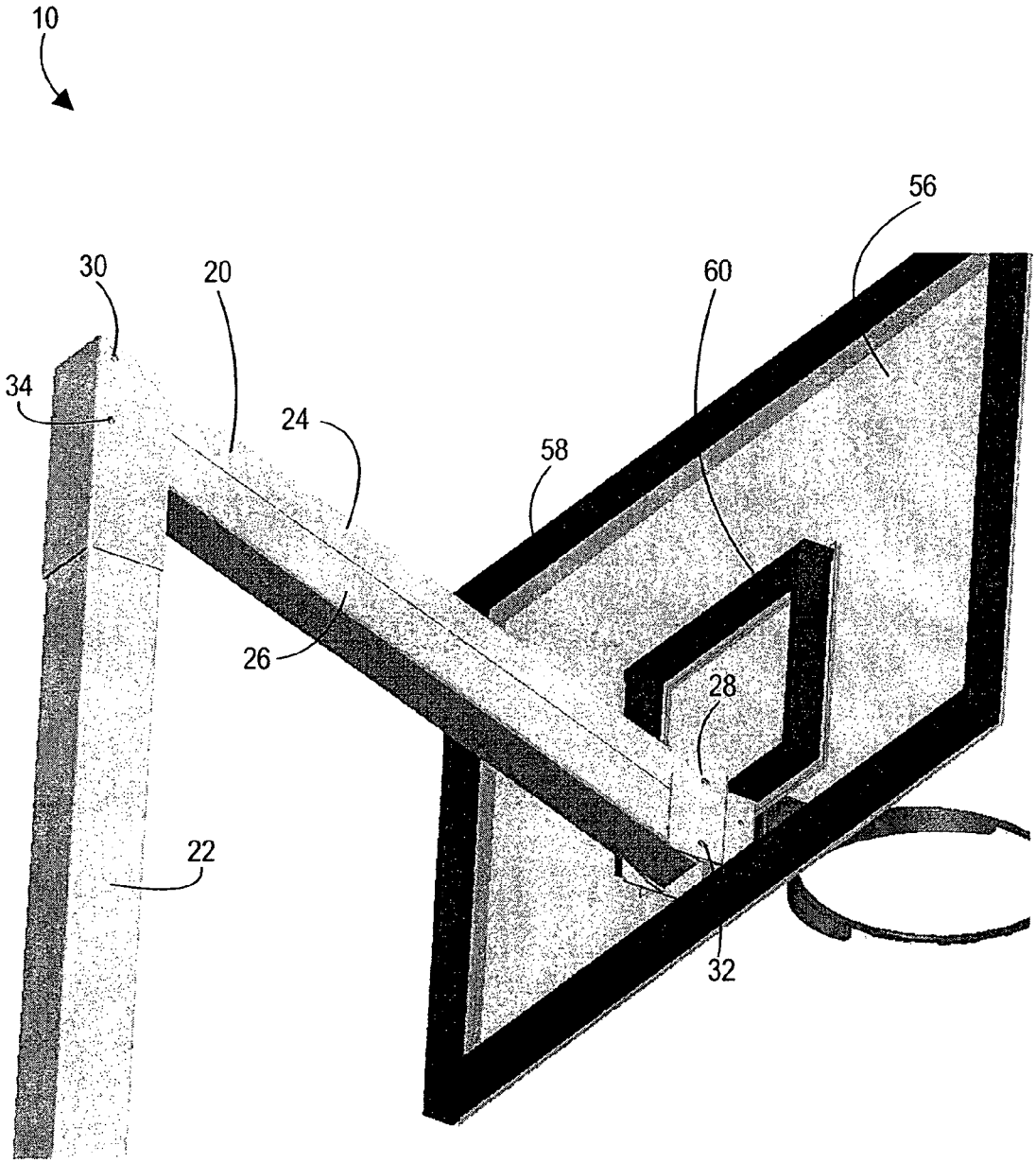
FIG. 7 is another enlarged rear perspective view of a portion of the basketball system shown in FIG. 5.
Figure 8:
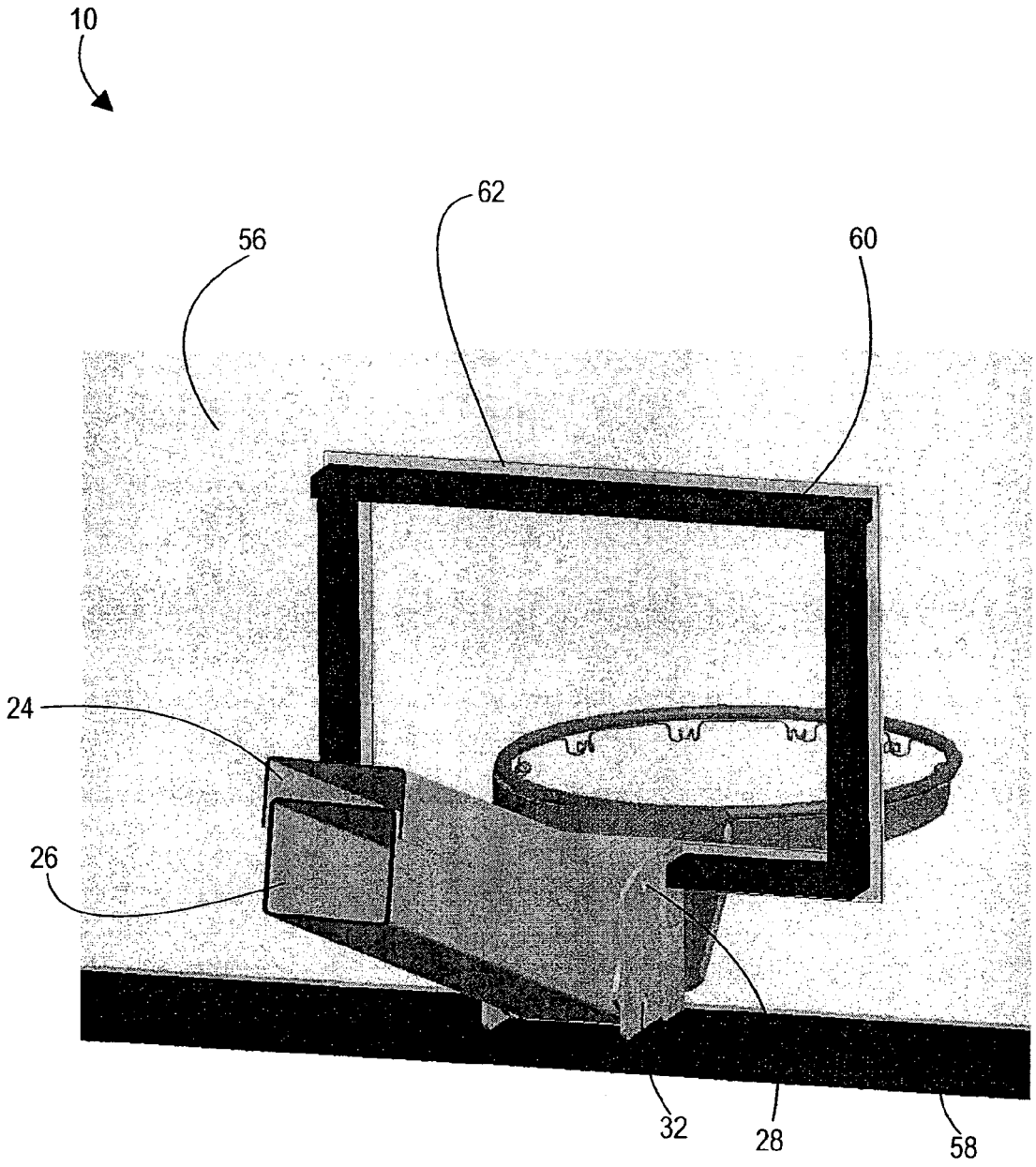
FIG. 8 is yet another enlarged rear perspective view of a portion of the basketball system shown in FIG. 5.
Figure 13:
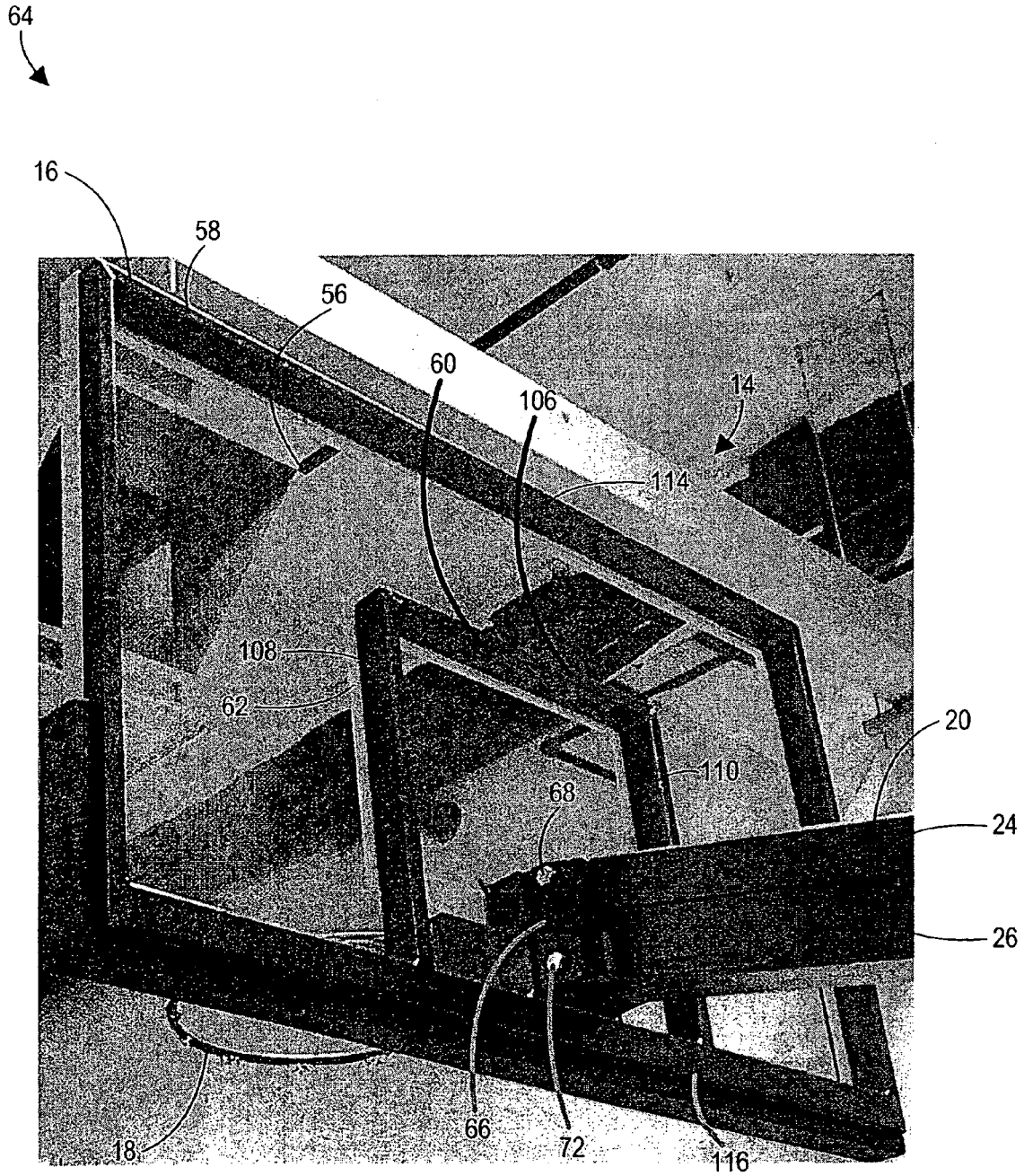
FIG. 13 is a rear perspective view of a portion of the basketball system shown in FIG. 10.
Figure 14:
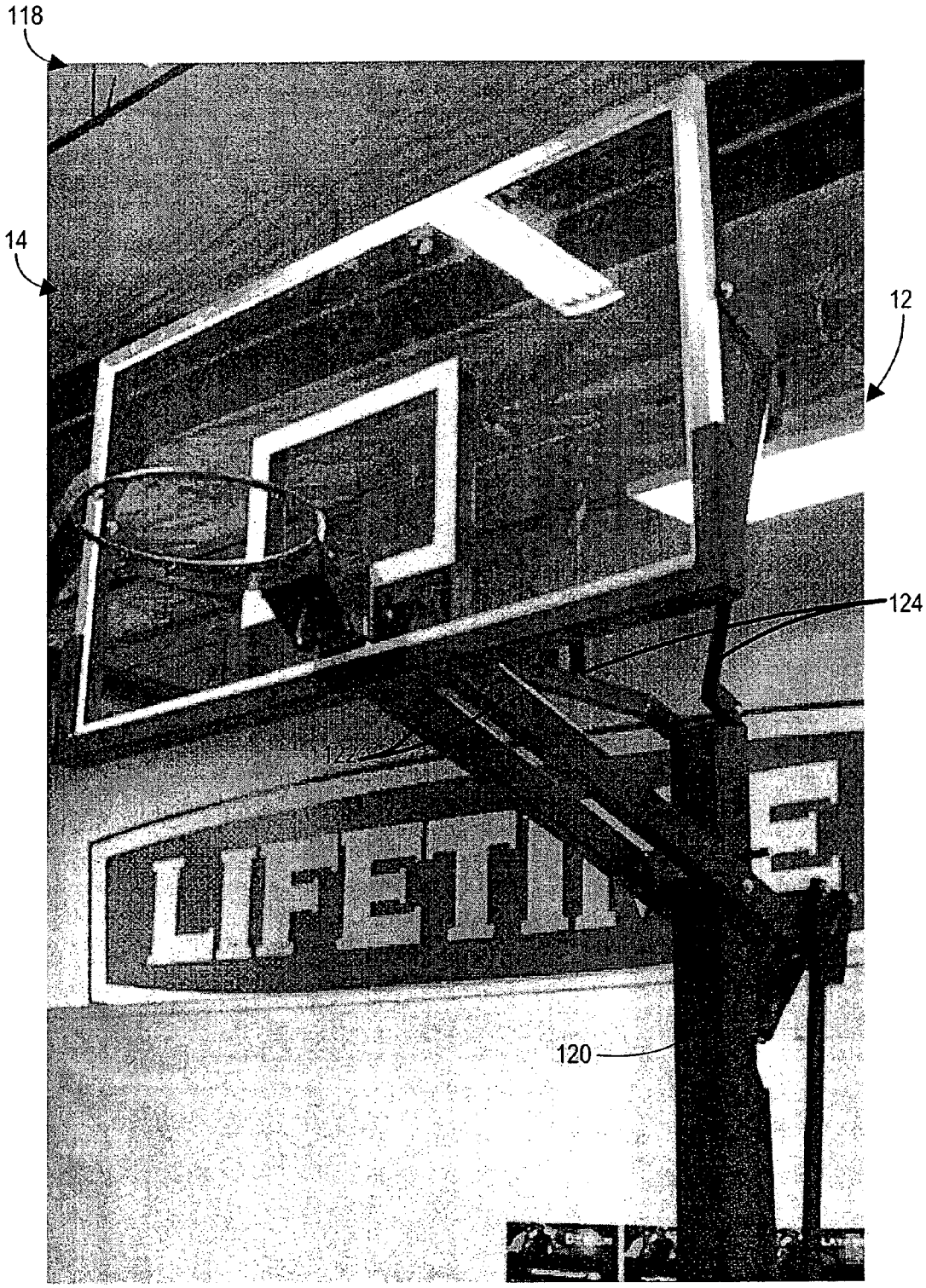
FIG. 14 is a front perspective view of yet another exemplary basketball system.
Figure 15:
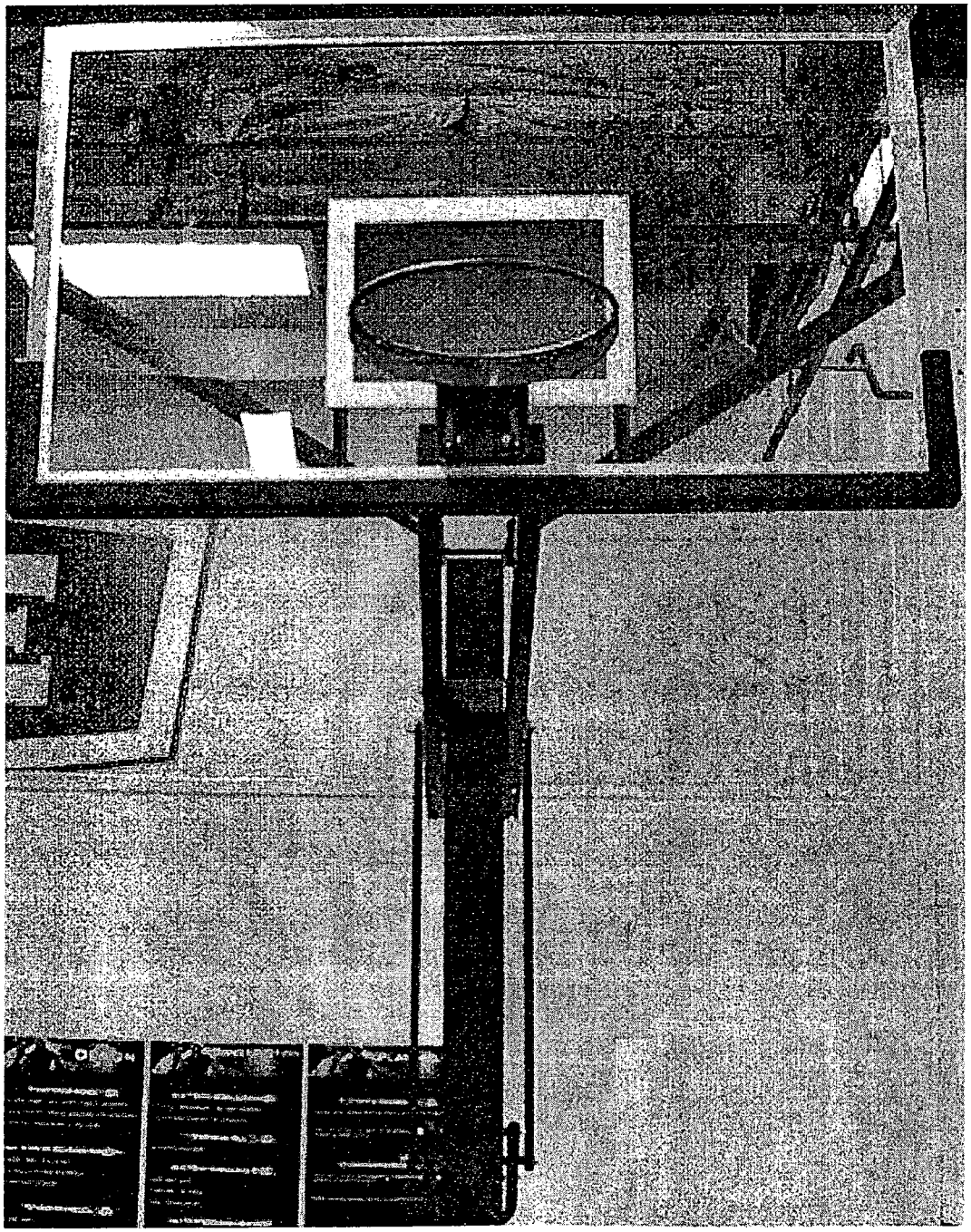
FIG. 15 is another front perspective view of the basketball system shown in FIG. 14.
Figure 16:
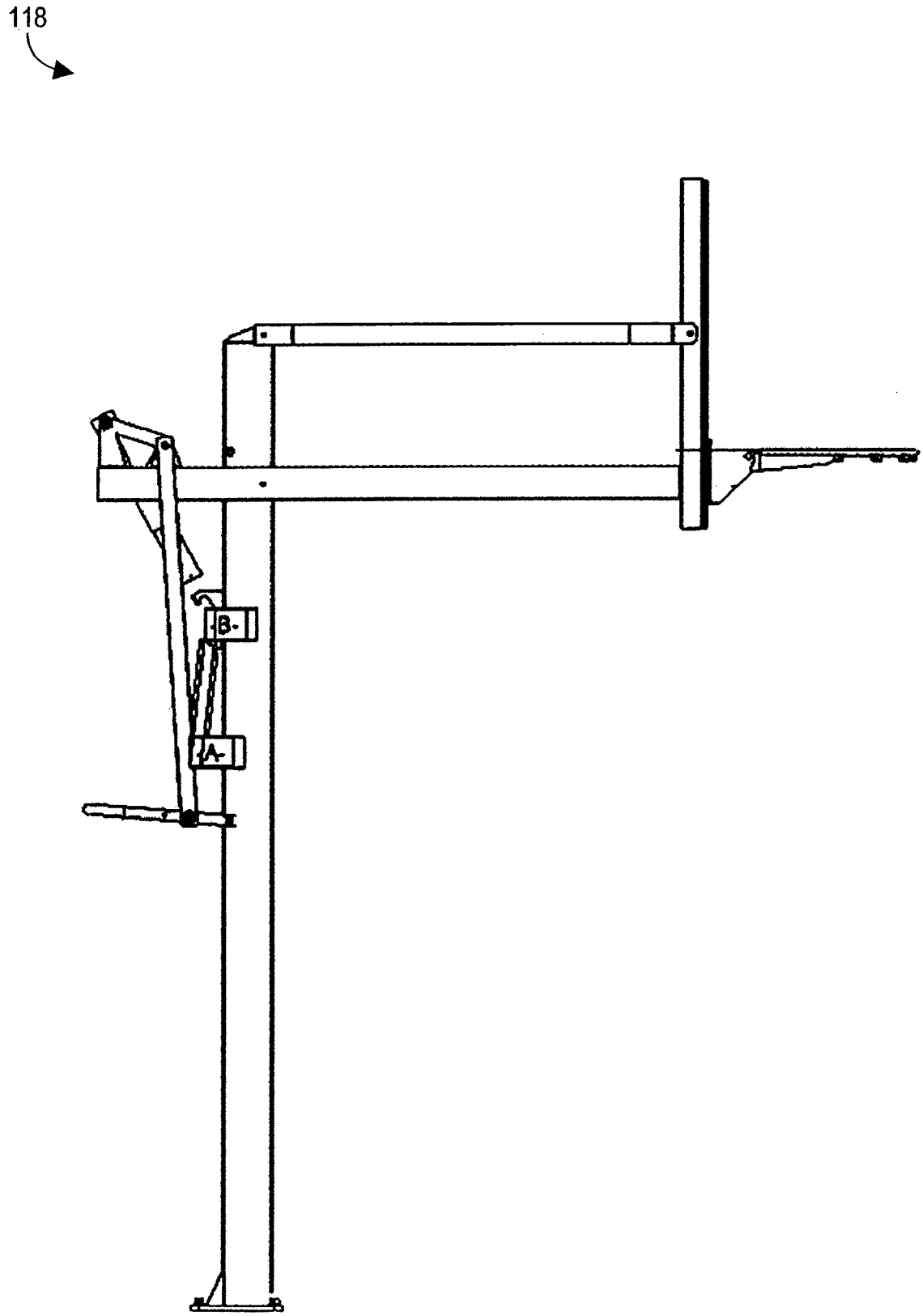
FIG. 16 is a side view of the basketball system shown in FIG. 14.
Figure 17:
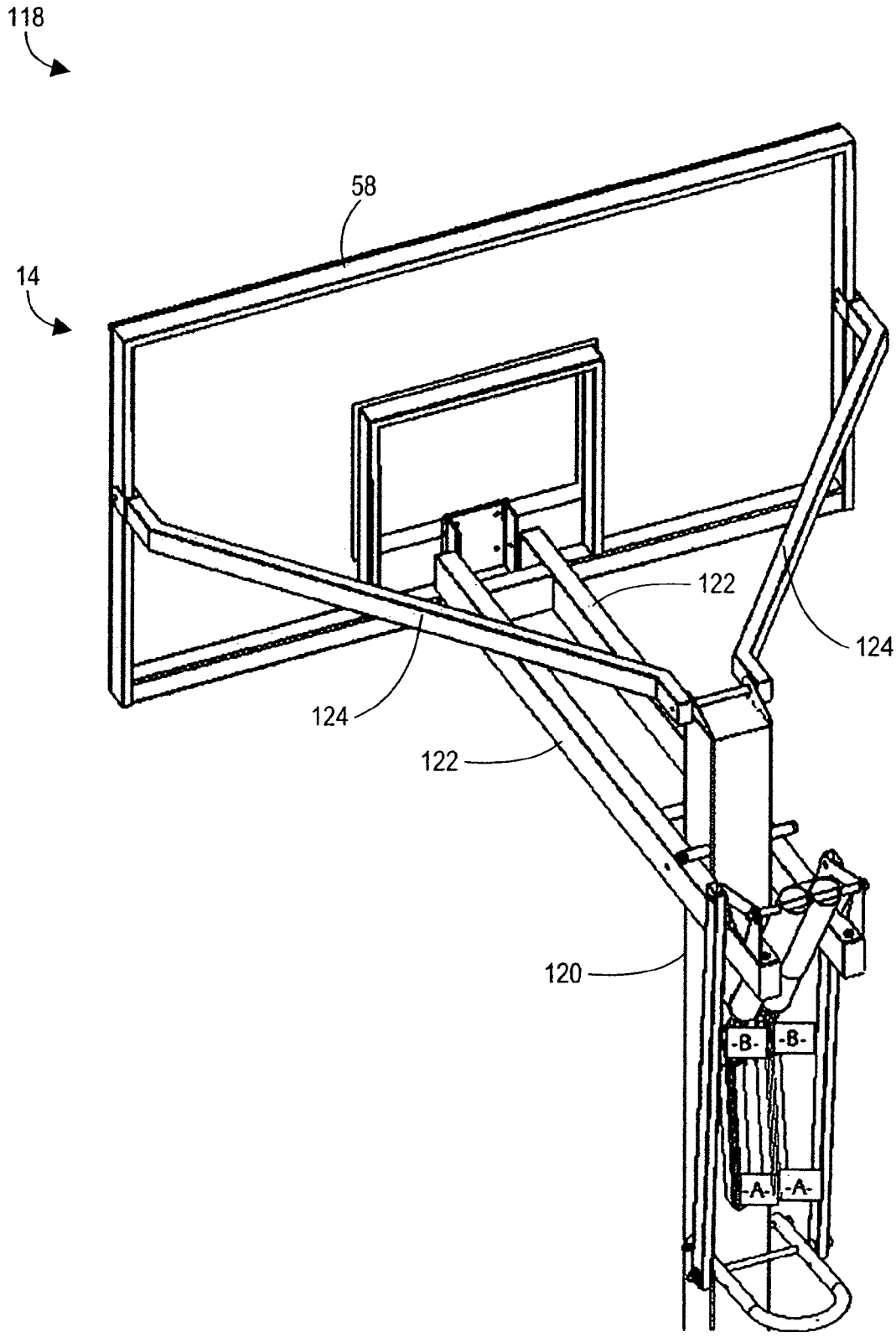
FIG. 17 is a rear perspective view of the basketball system shown in FIG. 14.
Figure 18:
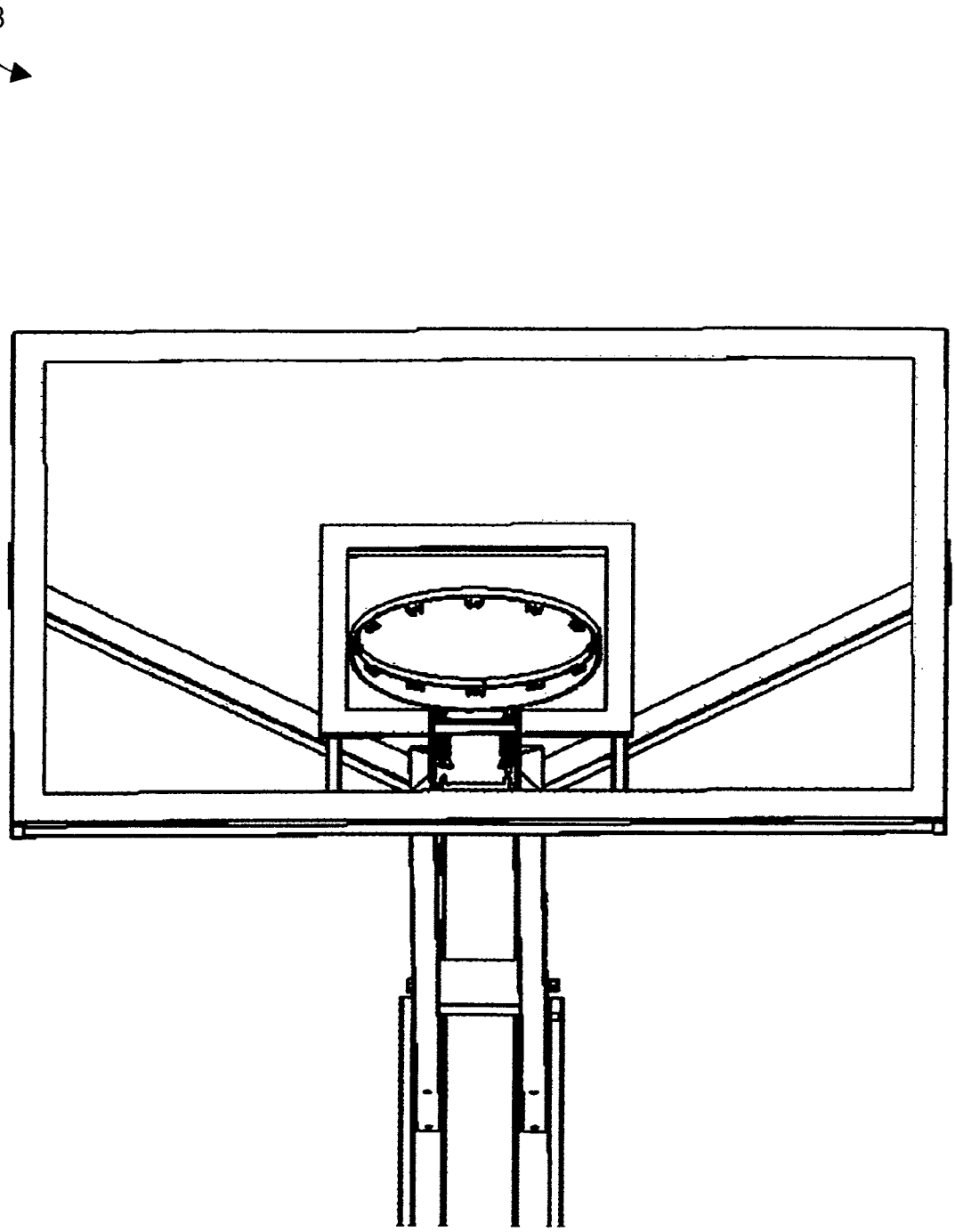
FIG. 18 is still another front perspective view of a portion of the basketball system shown in FIG. 14.

As discussed above, the basketball system may include a generally centrally located weight 60 that is sized and configured to add mass to provide enhanced rebounding characteristics. As best seen in FIGS. 6 and 13, the weight 60 preferably includes an upper portion 106 that extends between a first side portion 108 and a second side portion 110. As shown in FIG. 6, the weight 60 may also include a lower portion 112. The upper portion 106, the first side portion 108, the second side portion 110 and the lower portion 112 may be generally positioned behind corresponding upper, side and lower portions of the target 62, which may advantageously provide a less cluttered and less distracting background to a person using the basketball system. As shown in FIGS. 6 and 13, the side portions 108, 110 are preferably spaced apart from an upper edge 114 of the frame 58, which may also provide a less cluttered and less distracting background. As shown in FIG. 6, the side portions 108, 110 may be spaced apart from a lower edge 116 of the frame 58, and, as shown in FIG. 13, the side portions 108, 110 may extend to the lower edge of the frame and/or comprise a portion of the frame. As discussed above, the weight 60 and the target 62 may have a variety of suitable configurations, arrangements and the like.

As shown in FIGS. 14-18, another exemplary basketball system 118 may include a support structure 12 with a support member 120 that has a pair of lower support arms 122 and a pair of upper support arms 124. The lower support arms 122 are preferably connected to a lower portion of the backboard and the support member 120 and the upper support arms are preferably connected to an upper portion of the backboard and the support member. As shown in the accompanying figures, the lower support arms 122 may be connected to or disposed proximate the center portion of the backboard. In particular, the lower support arms 122 may be connect to or disposed proximate the rim. The lower support arms 122 may also be generally straight and disposed in a generally parallel configuration. In addition, the lower support arms 122 may be connected to the sides of the support member 120 and the lower support arms may be spaced apart by a distance that is generally equal to the width of the support member.

The upper support arms 124 are preferably sized and configured to extend from the support member 120 to the edges of the frame 58 of the backboard. For example, as shown in the accompanying figures, the upper support arms 124 may be connected to the upper portion of the support member and the arms may be curved or bent to allow the arms to be connected to the outer portion of the backboard. It will be appreciated that the lower and upper support arms 122, 124 may have other suitable shapes, sizes, configurations and arrangements depending, for example, upon the intended use of the basketball system 118. It will also be appreciated that the support arms 122, 124 may be used in connection with any suitable type of height adjustment mechanism, such as the height adjustment mechanisms discussed above.

As shown in FIGS. 14-18, the basketball backboard may include the frame 58 and/or be supported by the frame. The frame 58 may have a generally tubular construction and it may have a generally rectangular configuration. The frame 58 may also include a plurality of openings that are sized and configured to receive one or more fasteners adapted to attach the support arms 122 and/or the support arms 124 to be connected to the frame. The tubular construction of the frame 58 may allow the openings to be more easily drilled or otherwise formed in the frame. It will be appreciated, however, that the frame 58 does not require a tubular construction or openings and may have a variety of other constructions or features. It will also be appreciated that the frame 58, the support member 120, the lower support arms 122 and/or the upper support arms 124 may have other suitable shapes, sizes, arrangements and configurations depending, for example, upon the intended use of the basketball system.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball system comprising:

a basketball goal including a backboard and a rim;

a support structure that is sized and configured to support the basketball goal above a playing surface;

a connection assembly connecting the basketball goal and the support structure, the connection assembly comprising:

a first connecting member including a first end connected to the basketball goal and a second end connected to the support structure; and a second connecting member including a body portion that is at least substantially disposed within the first connecting member and an extension that is not disposed within the first connecting member, a first end of the body portion connected to the basketball goal and a second end of the body portion connected to the support structure, the extension extending beyond the support structure; and a height adjustment mechanism connected to the support structure, the height adjustment mechanism comprising:

an arm including a first end connected to the extension of the second connecting member of the connection assembly; and a handle connected to the support structure, the handle being movable to allow the height of the basketball goal to be moved relative to the playing surface.

2. The basketball system as in claim 1, wherein the handle connects a second end of the arm of the height adjustment mechanism to the support structure; and wherein the height adjustment mechanism includes a trigger to selectively lock and unlock the height adjustment assembly at a desired height.

3. The basketball system as in claim 1, further comprising a first biasing member connected to the extension of the second connecting member of the connection assembly.

4. The basketball system as in claim 3, further comprising a second biasing member connected to the extension of the second connecting member of the connection assembly.

5. The basketball system as in claim 1, further comprising a first dampener connected to the extension of the second connecting member of the connection assembly.

6. The basketball system as in claim 5, further comprising a second dampener connected to the extension of the second connecting member of the connection assembly.

7. The basketball system as in claim 1, further comprising a bracket connected to an upper portion of the support structure, the bracket being sized and configured to allow the second connecting member to extend through the bracket with a first portion of the second connecting member disposed on a front side of the support structure and a second portion of the second connecting member disposed on a rear side of the support structure.

8. The basketball system as in claim 1, wherein the backboard includes a rebound member and a frame;

wherein a target is disposed on the rebound member, the target having a generally rectangular configuration and is spaced apart from the perimeter and frame of the backboard, the target being at least substantially disposed above the rim and being sized and configured to facilitate shooting a basketball; and wherein a mass is disposed behind the rebound member, the mass including an upper portion that is generally aligned with an upper portion of the target, the mass including a right side portion that is generally aligned with a right side of the target, the mass including a left side portion that is generally aligned with a left side of the target.

9. The basketball system as in claim 8, wherein the mass is spaced apart from the frame of the backboard.

10. The basketball system as in claim 8, wherein the mass is directly connected to the connection assembly.

11. The basketball system as in claim 8, wherein the mass is spaced apart from the target by a distance.

12. A basketball system comprising:

a basketball goal including a backboard and a rim, the backboard comprising:

a frame; and a rebound member connected to the frame;

a support structure that is sized and configured to support the basketball goal above a playing surface;

a connection assembly connecting the basketball goal and the support structure, the connection assembly comprising:

a first connecting member including a first end connected to the basketball goal and a second end connected to the support structure; and a second connecting member including a body portion that is at least substantially disposed within the first connecting member and an extension that is not disposed within the first connecting member, a first end of the body portion connected to the basketball goal and a second end of the body portion connected to the support structure, the extension extending beyond a rear portion of the support structure;

a height adjustment mechanism that is sized and configured to allow a height of the basketball goal to be adjusted relative to the playing surface, the height adjustment mechanism comprising:

an arm including a first end connected to the extension of the second connecting member of the connection assembly; and a handle connected to the support structure and a second end of the arm, the handle being movable to allow the height of the basketball goal to be moved relative to the playing surface; and a mass having a generally rectangular configuration disposed behind the rebound member of the backboard, the mass including a horizontally disposed upper portion, a vertically disposed right side portion and a vertically disposed left side portion, the mass being at least substantially disposed above the rim.

13. The basketball system as in claim 12, wherein the backboard includes a target disposed on the rebound member, the target having a generally rectangular configuration and being spaced apart from the perimeter of the backboard, the target being at least substantially disposed above the rim and being sized and configured to facilitate shooting a basketball; and wherein the mass is generally aligned with the rebound member with the upper portion of the mass generally aligned with an upper portion of the target, the right side portion of the mass generally aligned with a right side of the target, and the left side portion of the mass generally aligned with a left side of the target.

14. The basketball system as in claim 12, wherein the mass is spaced apart from the frame of the backboard.

15. The basketball system as in claim 12, wherein the mass is directly connected to the connection assembly.

16. The basketball system as in claim 12, wherein the mass is spaced apart from a target by a distance.

17. A basketball system comprising:

a basketball goal including a backboard and a rim, the backboard comprising:

a frame; and a rebound member connected to the frame;

a support structure that is sized and configured to support the basketball goal above a playing surface;

a connection assembly connecting the basketball goal and the support structure, the connection assembly comprising:

a first connecting member including a first end connected to the frame of the basketball goal and a second end connected to the support structure; and a second connecting member including a body portion that is at least substantially disposed within the first connecting member and an extension that is not disposed within the first connecting member, a first end of the body portion connected to the frame of the basketball goal and a second end of the body portion connected to the support structure, the extension extending beyond a rear portion of the support structure; and a height adjustment mechanism connected to the support structure, the height adjustment mechanism comprising:

an arm including a first end connected to the extension of the second connecting member of the connection assembly; and a handle connected to a second end of the arm and the support structure, the handle being movable to allow the height of the basketball goal to be moved relative to the playing surface.

18. The basketball system as in claim 17, first comprising a first biasing member connected to the extension of the second connecting member of the connection assembly; and further comprising a second biasing member connected to the extension of the second connecting member of the connection assembly.

19. The basketball system as in claim 17, wherein the backboard includes a rebound member and a frame;

wherein a target is disposed on the rebound member, the target having a generally rectangular configuration and is spaced apart from the perimeter and frame of the backboard, the target being at least substantially disposed above the rim and being sized and configured to facilitate shooting a basketball; and wherein a mass is disposed behind the rebound member, the mass including an upper portion that is generally aligned with an upper portion of the target, the mass including a right side portion that is generally aligned with a right side of the target, the mass including a left side portion that is generally aligned with a left side of the target.

20. The basketball system as in claim 8, wherein the mass is spaced apart from the frame of the backboard.

* * * * *

UNITED STATES PATENT AND TRADEMARK OFFICE

CERTIFICATE OF CORRECTION

PATENT NO. : 7,775,917 B2
APPLICATION NO. : 11/500791
DATED : August 17, 2010
INVENTOR(S) : Nye et al.

It is certified that error appears in the above-identified patent and that said Letters Patent is hereby corrected as shown below:

Column 2
Line 17, change "a" to --include a--
Line 45, change "of" to --of a--

Column 4
Line 7, delete "a"

Column 5
Line 23, change "10" to --10--

Column 7
Line 64, change "counters" to --counter--

Column 39
Line 39, change "have" to --have to--

Column 11
Line 32, change "deactivated" to --be deactivated--

Column 12
Line 35, change "1 00" to --100--

Signed and Sealed this
First Day of February, 2011

David J. Kappos

David J. Kappos
*Director of the United States Patent and Trademark Office*